US005524468A

United States Patent [19]

Jentzsch et al.

[11] Patent Number: 5,524,468

[45] **Date of Patent: * Jun. 11, 1996**

[54] APPARATUS AND METHOD FOR STRENGTHENING BOTTOM OF CONTAINER

[75] Inventors: K. Reed Jentzsch; Mark A. Jacober, both of Arvada, Colo.

[73] Assignee: Ball Corporation, Muncie, Ind.

[ * ] Notice: The portion of the term of this patent subsequent to Apr. 28, 2013, has been disclaimed.

[21] Appl. No.: 268,775

[22] Filed: Jun. 30, 1994

Related U.S. Application Data

[63] Continuation of Ser. No. 54,787, Apr. 28, 1993, Pat. No. 5,325,696, which is a continuation of Ser. No. 799,241, Sep. 20, 1991, abandoned, which is a continuation-in-part of Ser. No. 600,943, Oct. 22, 1990, Pat. No. 5,105,973 Apr. 21, 1992.

[51] Int. Cl.[6] ..... B21D 51/26

[52] U.S. Cl. ..... 72/117; 72/379.4

[58] Field of Search ..... 72/68, 94, 117, 72/123, 379.4, 71, 110, 111, 120, 122, 123, 124, 125, 126, 393; 413/69

[56] References Cited

U.S. PATENT DOCUMENTS

| | | | |
|---|---|---|---|
| 774,672 | 11/1904 | Baeumle . | |
| 994,468 | 6/1911 | Kane . | |
| 1,031,264 | 7/1912 | Hinde et al. . | |
| 1,441,674 | 1/1923 | Foster et al. . | |
| 1,461,729 | 7/1923 | Foster et al. . | |
| 1,524,946 | 2/1925 | Nystrom . | |
| 1,711,844 | 5/1929 | Mauser . | |
| 2,158,312 | 5/1939 | Terrell | 113/48 |
| 2,215,731 | 9/1940 | Williams et al. | 153/7 |
| 2,608,914 | 9/1952 | Merkle | 93/36.5 |
| 2,618,182 | 11/1952 | Teetor | 80/5.1 |
| 3,349,956 | 10/1967 | Stephan | 220/97 |
| 3,693,828 | 9/1972 | Kneusel et al. | 220/66 |
| 3,730,383 | 5/1973 | Dunn et al. | 220/66 |
| 3,760,751 | 9/1973 | Dunn et al. | 113/120 |
| 3,904,069 | 9/1975 | Toukmanian | 220/65 |
| 3,905,507 | 9/1975 | Lyu | 220/66 |
| 3,913,366 | 10/1975 | Nelsen et al. | 72/94 |
| 3,942,673 | 3/1976 | Lyu et al. | 220/66 |
| 3,998,174 | 12/1976 | Saunders | 113/120 |
| 4,108,324 | 8/1978 | Krishnakumar et al. | 215/1 |

(List continued on next page.)

FOREIGN PATENT DOCUMENTS

| | | | |
|---|---|---|---|
| 0337500A2 | 10/1989 | European Pat. Off. . | |
| 1514970 | 6/1967 | France . | |
| 3930937A1 | 3/1991 | Germany . | |
| 1345040 | 1/1974 | United Kingdom . | |
| WO83/02577 | 8/1983 | WIPO . | |
| 9111275 | 8/1991 | WIPO | 72/94 |

*Primary Examiner*—Lowell A. Larson
*Attorney, Agent, or Firm*—Gilbert E. Alberding

[57] ABSTRACT

Apparatus (110, 180, 270, 330, or 360) either reforms a circumferential part (86) of a container body (11) radially outward to form a container body (64), or reforms a plurality of circumferentially-spaced parts (74) of the bottom recess portion (25) of a container body (11) radially outward to form a container body (62). The apparatus (110, 180, 270, 330, or 360) includes a body (158, 230, 288, 332, or 365) and has a tooling element attached thereto which may be a roller (172, 246, 302, or 350) or a swaging element (392). Means is included for providing relative transverse movement between the container body (11) and the tooling element (172, 246, 302, 346, or 392). Means (160, 222, 296, or 332) is provided for providing relative rotary movement between the container body (11) and the tooling element (172, 246, 302, or 346) in all embodiments except the apparatus (360) in which the bottom recess portion (25) is swaged. The method includes providing relative transverse movement between the container body (11) and the tooling element (172, 246, 302, 346, or 392), and in all embodiments except the one (360) in which reworking is achieved by swaging, relative rotary movement between the container body (11) and the tooling element (172, 246, 302, or 346) is provided.

39 Claims, 19 Drawing Sheets

U.S. PATENT DOCUMENTS

| | | | |
|---|---|---|---|
| 4,120,419 | 10/1978 | Saunders | 220/66 |
| 4,147,271 | 4/1979 | Yamaguchi | 220/70 |
| 4,151,927 | 5/1979 | Cvacho et al. | 220/70 |
| 4,289,014 | 9/1981 | Maeder et al. | 72/348 |
| 4,294,373 | 10/1981 | Miller et al. | 220/70 |
| 4,341,321 | 7/1982 | Gombas | 220/66 |
| 4,372,143 | 2/1983 | Elert et al. | 72/343 |
| 4,412,627 | 11/1983 | Houghton et al. | 220/66 |
| 4,515,284 | 5/1985 | Lee, Jr. et al. | 220/70 |
| 4,598,831 | 7/1986 | Nakamura et al. | 215/1 |
| 4,620,434 | 11/1986 | Pulciano et al. | 72/347 |
| 4,685,582 | 8/1987 | Pulciani et al. | 220/66 |
| 4,732,292 | 3/1988 | Supik | 220/70 |
| 4,768,672 | 9/1988 | Pulciani et al. | 220/66 |
| 4,834,256 | 5/1989 | McMillin | 220/66 |
| 4,885,924 | 12/1989 | Claydon et al. | 72/109 |
| 4,919,294 | 4/1990 | Kawamoto et al. | 220/70 |
| 4,953,738 | 9/1990 | Stirbis | 220/606 |
| 5,105,973 | 4/1992 | Jentzsch et al. . | |
| 5,222,385 | 6/1993 | Halasz et al. | 72/117 |
| 5,325,696 | 7/1994 | Jentzsch et al. | 72/117 |
| 5,349,837 | 9/1994 | Halasz et al. | 72/94 |
| 5,355,709 | 10/1994 | Bauder et al. | 72/393 |

APPARATUS AND METHOD FOR STRENGTHENING BOTTOM OF CONTAINER

BACKGROUND OF THE INVENTION

This application is a continuation of U.S. patent application Ser. No. 08/054,787, filed Apr. 28, 1993, now U.S. Pat. No. 5,325,606 which is a continuation of U.S. patent application Ser. No. 07/799,241, filed Sep. 20, 1991, now abandoned, which is a continuation-in-part of U.S. patent application Ser. No. 07/600,943, issued Oct. 22, 1990, now U.S. Pat. No. 5,105,973, issued Apr. 21, 1992.

FIELD OF THE INVENTION

The present invention relates generally to metal container bodies of the type having a seamless sidewall and a bottom formed integrally therewith. More particularly, the present invention relates to bottom contours that provide increased dome reversal pressure, that provide greater resistance to damage when dropped, that minimize or prevent growth in the height of a container in which the beverage is subjected to pasteurizing temperatures and/or extreme temperatures encountered in shipping and storage. Further, the present invention relates to apparatus and method for providing these improved bottom contours.

DESCRIPTION OF THE RELATED ART

There have been numerous container configurations of two-piece containers, that is, containers having a container body with an integral bottom wall at one end, and an open end that is configured to have a closure secured thereto. Container manufacturers package beverages of various types in these containers formed of either steel or aluminum alloys.

In the production of these container bodies, it is important that the body wall and bottom wall of the container be as thin as possible so that the container can be sold at a competitive price. Much work has been done on thinning the body wall.

Aside from seeking thin body wall structures, various bottom wall configurations have been investigated. An early attempt in seeking sufficient strength of the bottom wall was to form the same into a spherical dome configuration. This general configuration is shown in Dunn et al., U.S. Pat. No. 3,760,751, issued Sep. 25, 1973. The bottom wall is thereby provided with an inwardly concave dome or bottom recess portion which includes a large portion of the area of the bottom wall of the container body. This domed configuration provides increased strength and resists deformation of the bottom wall under increased internal pressure of the container with little change in the overall geometry of the bottom wall throughout the pressure range for which the container is designed.

The prior art that teaches domed bottoms also includes P. G. Stephan, U.S. Pat. No. 3,349,956, issued Oct. 31, 1967; Kneusel et al., U.S. Pat. No. 3,693,828, issued Sep. 26, 1972; Dunn et al., U.S. Pat. No. 3,730,383, issued May 1, 1973; Toukmanian, U.S. Pat. No. 3,904,069, issued Sep. 9, 1975; Lyu et al., U.S. Pat. No. 3,942,673, issued Mar. 9, 1976; Miller et al., U.S. Pat. No. 4,294,373, issued Oct. 13, 1981; McMillin, U.S. Pat. No. 4,834,256, issued May 30, 1989; Pulciani et al., U.S. Pat. No. 4,685,582, issued Aug. 11, 1987; and Pulciani, et al., U.S. Pat. No. 4,768,672, issued Sep. 6, 1988.

Patents which teach apparatus for forming container bodies with inwardly domed bottoms and/or which teach container bodies having inwardly domed bottoms, include Maeder et al., U.S. Pat. No. 4,289,014, issued Sep. 15, 1981; Gombas, U.S. Pat. No. 4,341,321, issued Jul. 27, 1982; Elert et al., U.S. Pat. No. 4,372,143, issued Feb. 8, 1983; and Pulciani et al., U.S. Pat. No. 4,620,434, issued Nov. 4, 1986.

Of the above-mentioned patents, Lyu et al. teaches an inwardly domed bottom in which the shape of the domed bottom is ellipsoidal.

Stephan, in U.S. Pat. No. 3,349,956, teaches using a reduced diameter annular supporting portion with an inwardly domed bottom disposed intermediate of the reduced diameter annular supporting portion. Stephan also teaches stacking of the reduced diameter annular supporting portion inside the double-seamed top of another container.

Kneusel et al., in U.S. Pat. No. 3,693,828, teach a steel container body having a bottom portion which is frustoconically shaped to provide a reduced diameter annular supporting portion, and having an internally domed bottom that is disposed radially inwardly of the annular supporting portion. Various contours of the bottom are adjusted to provide more uniform coating of the interior bottom surface, including a reduced radius of the domed bottom.

Pulciani et al., in U.S. Pat. Nos. 4,685,582 and 4,768,672, instead of the frustoconical portion of Kneusel et al., teach a transition portion between the cylindrically shaped outer wall of the container body and the reduced diameter annular supporting portion that includes an upper annular arcuate portion that is convex with respect to the outside diameter of the container body and a lower annular arcuate portion that is concave with respect to the outside diameter of the container body.

McMillin, in U.S. Pat. No. 4,834,256, teaches a transitional portion between the cylindrically shaped outer wall of the container body and the reduced diameter annular supporting portion that is contoured to provide stable stacking for containers having a double-seamed top which is generally the same diameter as the cylindrical outer wall, as well as providing stable stacking for containers having double-seamed tops that are smaller than the cylindrical body. In this design, containers with reduced diameter tops stack inside the reduced diameter annular supporting portion; and containers with larger tops stack against this specially contoured transitional portion.

Supik, in U.S. Pat. No. 4,732,292, issued Mar. 22, 1988, teaches making indentations in the bottom of a container body that extend upwardly from the bottom. Various configurations of these indentations are shown. The indentations are said to increase the flexibility of the bottom and thereby prevent cracking of interior coatings when the containers are subjected to internal fluid pressures.

In U.S. Pat. No. 4,885,924, issued Dec. 12, 1989, which was disclosed in W.I.P.O. International Publication No. WO 83/02577 of Aug. 4, 1983, Claydon et al. teach apparatus for rolling the outer surface of the annular supporting portion radially inward, thereby reducing the radii of the annular supporting portion. The annular supporting portion is rolled inwardly to prevent inversion of the dome when the container is subjected to internal fluid pressures.

Various of the prior art patents, including Pulciani et al., U.S. Pat. No. 4,620,434, teach contours which are designed to increase the pressure at which fluid inside the container reverses the dome at the bottom of the container body. This pressure is called the static dome reversal pressure. In this patent, the contour of the transitional portion is given such great emphasis that the radius of the domed panel, though generally specified within a range, is not specified for the preferred embodiment.

However, it has been known that maximum values of static dome reversal pressure are achieved by increasing the curvature of the dome to an optimum value, and that further increases in the dome curvature result in decreases in static dome reversal pressures.

As mentioned earlier, one of the problems is obtaining a maximum dome reversal pressure for a given metal thickness. However, another problem is obtaining resistance to damage when a filled container is dropped onto a hard surface.

Present industry testing for drop resistance is called the cumulative drop height. As performed for tests reported herein, a filled container is dropped onto a steel plate from heights beginning at three inches and increasing by three inches for each successive drop. The drop height resistance is then the sum of all the distances at which the container is dropped, including the height at which the dome is reversed, or partially reversed. That is, the drop height resistance is the cumulative height at which the bottom contour is damaged sufficiently to preclude standing firmly upright on a flat surface.

In U.S. patent application Ser. No. 07/505,618 having common inventorship entity, and being of the same assignee as the present application, it was shown that decreasing the dome radius of the container body increases the cumulative drop height resistance and decreases the dome reversal pressure. Further, it was shown in this prior application that increasing the height of the inner wall increases the dome reversal pressure.

However, as the dome radius is decreased for a given dome height, the inner wall decreases in height. Therefore, for a given dome height, an increase in cumulate drop resistance, as achieved by a decrease in dome radius, results in a decrease in the height of the inner wall together with an attendant decrease in the dome reversal pressure.

Thus, one way to achieve a good combination of cumulative drop height and dome reversal pressure, is to increase the dome height, thereby allowing a reduction in dome radius while leaving an adequate wall height. However, there are limits to which the dome height can be increased while still maintaining standard diameter, height, and volume specifications.

An additional problem in beverage container design and manufacturing has been in maintaining containers within specifications, subsequent to a pasteurizing process, when filled beverage containers are stored at high ambient temperatures, and/or when they are exposed to sunlight.

This increase in height is caused by roll-out of the annular supporting portion as the internal fluid pressure on the domed portion applies a downward force to the circumferential inner wall, and the circumferential inner wall applies a downward force on the annular supporting portion.

An increase in the height of a beverage container causes jamming of the containers in filling and conveying equipment, and unevenness in stacking.

A large quantity of containers are manufactured annually and the producers thereof are always seeking to reduce the amount of metal utilized in making container bodies while still maintaining the same operating characteristics.

Because of the large quantities of container bodies manufactured, a small reduction in metal thickness, even of one ten thousandth of an inch, will result in a substantial reduction in material costs.

SUMMARY OF THE INVENTION

According to the present invention, apparatus and method are provided for reforming the bottom recess portion of a drawn and ironed beverage container body. When reformed as taught herein, the dome reversal pressure of a the container is increased without increasing the metal thickness, increasing the height of an inner wall that surrounds the domed portion, increasing the total dome height, or decreasing the dome radius.

Further, in the present invention, both increased resistance to roll-out of the annular supporting portion and increased cumulative drop height resistance of containers are achieved without any increase in metal content, and without any changes in the general size or shape of the container body.

A container body which provides increased resistance to roll-out, increased dome reversal pressure, and increased cumulative drop height resistance includes a cylindrical outer wall that is disposed around a container axis, a bottom that is attached to the outer wall and that provides a supporting surface, and a bottom recess portion that is disposed radially inwardly of the supporting surface, that includes a center panel, or concave domed panel, and that includes a circumferential dome positioning portion that disposes the center panel a positional distance above the supporting surface.

In one embodiment of the present invention, the bottom recess portion of the container body includes a part thereof that is disposed at a first vertical, distance above the supporting surface and at a first radial distance from the container axis; and the bottom recess portion also includes an adjacent part that is disposed at a greater vertical distance above the supporting surface and at a greater radial distance from the container axis than the first part.

That is, the bottom recess portion includes an adjacent part that extends radially outward from a first part that is closer to the supporting surface. In this configuration, this adjacent part extends circumferentially around the container body, thereby providing an annular radial recess that hooks outwardly of the part of the bottom recess that is closer to the supporting surface.

In another embodiment of the present invention, the adjacent part of the bottom recess portion is arcuate and extends for only a portion of the circumference of the bottom recess portion. Preferably a plurality of adjacent parts, and more preferably five adjacent parts, extend radially outward from a plurality of the first parts, and are interposed between respective ones of the first parts.

That is, a plurality of strengthening parts are disposed in the circular inner wall of the bottom recess portion, and either extend circumferentially around the bottom recess portion or are circumferentially spaced. The strengthening parts project either radially outwardly or radially inwardly with respect to the circular inner wall.

The strengthening parts may be contained entirely within the inner wall, may extend downwardly into the annular supporting surface, portion, may extend upwardly into the concave annular portion that surrounds the domed portion, and/or may extend upwardly into both the concave annular portion and the concave domed panel.

The strengthening parts may be round, elongated vertically, may be elongated circumferentially, and/or may be elongated at an angle between vertical and circumferential.

The container of the present invention provides a container with improved static dome reversal pressure without any increase in material, and without any change in dimensions that affects interchangeability of filling and/or packaging machinery.

Further, the container of the present invention provides enhanced resistance to pressure-caused roll-out and the resultant change in the overall height of the container that accompanies fluid pressures encountered during the pasteurizing process.

In addition, the container of the present invention provides improved cumulative drop height resistance without any increase in material, and without any changes in dimensions that affect interchangeability of filling machinery, thereby making possible a reduction of, or elimination of, cushioning that has been provided by carton and case packaging.

In one embodiment, the apparatus of the present invention rotates, the container body remains stationary, rollers of the apparatus move in a planetary path as the apparatus rotates, and the rollers move radially outward into deforming contact with the bottom recess portion of the container body in response to longitudinal movement of a portion of the apparatus.

The apparatus of this first embodiment of the present invention may be used as a part of a machine performing only the reforming functions taught herein. However, preferably, this apparatus is incorporated into a machine doing other can-making functions. More preferably, the apparatus of this first embodiment is incorporated into a machine in which the open ends of the container bodies are necked in first and second swaging steps.

In another embodiment, the apparatus of the present invention remains rotationally stationary, the container body is rotated, and rollers of the apparatus are moved radially outward into deforming contact with the bottom recess portion of the container body in response to longitudinal movement of a portion of the apparatus.

This apparatus of the present invention may be incorporated into a separate machine for reworking the recess bottom portion of the container body. However, preferably it is incorporated into a machine that performs other forming operations. More preferably, this embodiment of the present invention is incorporated into a machine that necks and spin flanges the open end of the container body.

In a first aspect of the present invention, apparatus is provided for reforming a container body having an outer wall that is disposed around a container axis, a bottom that is attached to the outer wall and that provides a supporting surface, a bottom recess portion that is disposed radially inwardly of the supporting surface and that includes an inner wall and an open end that is disposed distal from the bottom recess portion, which apparatus comprises a tooling device having a body, and having a tooling element that is operatively attached to the body; means for positioning the tooling element inside the bottom recess portion of the container body; means for providing relative transverse movement between the tooling element and the container body; and means, including the tooling element, and including the means for providing relative transverse movement between the tooling element and the container body, for displacing a part of the inner wall radially outward.

In a second aspect of the present invention, apparatus is provided for reforming a container body having an outer wall that is disposed around a container axis, a bottom that is attached to the outer wall and that provides a supporting surface, a bottom recess portion that is disposed radially inwardly of the supporting surface and that includes an inner wall and an open end that is disposed distal from the bottom, which apparatus comprises a machine having a structural member, and having a working station; a tooling device having a body that is operatively attached to the structural member, and having a tooling element that is operatively attached to the body; means for placing the container body in the working station; means for positioning the tooling element inside the bottom recess portion of the container body; means for providing relative transverse movement between the tooling element and the container body; means, including the tooling element, and including the means for providing relative transverse movement between the tooling element and the container body, for displacing a part of the inner wall radially outward; and means for reforming the container body proximal to the open end without removing the container body from the working station.

In a third aspect of the present invention, apparatus is provided for reforming a container body having an outer wall that is disposed around a container axis, a bottom that is attached to the outer wall and that provides a supporting surface, a bottom recess portion that is disposed radially inwardly of the supporting surface and that includes an inner wall and an open end that is disposed distal from the bottom, which apparatus comprises a machine having a structural member, and having a working station; a tooling device having a body that is operatively attached to the structural member, and having a tooling element that is operatively attached to the body; means for placing the container body in the working, station; means for positioning the tooling element inside the bottom recess portion of the container body; means for providing relative transverse movement between the tooling element and the container body; means, including the tooling element, and including the means for providing relative transverse movement between the tooling element and the container body, for displacing a part of the inner wall radially outward; and means for flanging the container body proximal to the open end without removing the container body from the working station.

In a fourth aspect of the present invention, apparatus is provided for reforming a container body having an outer wall that is disposed around a container axis, a bottom that is attached to the outer wall and that provides a supporting surface, a bottom recess portion that is disposed radially inwardly of the supporting surface and that includes an inner wall, and an open end that is disposed distal from the bottom, which apparatus comprises a machine having a structural member, and having a working station; a tooling device having a body that is operatively attached to the structural member, and having a tooling element that is operatively attached to the body; means for placing the container body in the working station; means for positioning the tooling element inside the bottom recess portion of the container body; means for providing relative transverse movement between the tooling element and the container body; means, including the tooling element, and including the means for providing relative transverse movement between the tooling element and the container body, for displacing a part of the inner wall radially outward; and means for necking the outer wall proximal to the open end without removing the container body from-the working station.

In a fifth aspect of the present invention, a method is provided for reforming a container body having an outer wall that is disposed around a container axis, a bottom that is attached to the outer wall and that provides a supporting surface, a bottom recess portion that is disposed radially inwardly of the supporting surface and that includes an inner wall, and an open end distal from the bottom, which method comprises positioning a tooling element inside the bottom recess portion of the container body; providing relative transverse movement between the tooling element and the container body; and using the tooling element to displace a portion of the inner wall radially outwardly.

In a sixth aspect of the present invention, a method is provided for reforming a container body having an outer wall that is disposed around a container axis, a bottom that is attached to the outer wall and that provides a supporting surface, a bottom recess portion that is disposed radially inwardly of the supporting surface and that includes an inner wall, and an open End distal from the bottom, which method comprises placing, the container body in a working station; positioning a tooling element inside the bottom recess portion of the container body; providing relative transverse movement between the tooling element and the container body; using the tooling element to displace a portion of the inner wall radially outwardly; and reforming the container body proximal to the open end while the container body remains in the working station.

In a seventh aspect of the present invention, a method is provided for reforming a container body having an outer wall that is disposed around a container axis, a bottom that is attached to the outer wall and that provides a supporting surface, a bottom recess portion that is disposed radially inwardly of the supporting surface and that includes an inner wall, and an open end distal from the bottom, which method comprises placing the container body in a working station; positioning a tooling element inside the bottom recess portion of the container body; providing relative transverse movement between the tooling element and the container body; using the tooling element to displace a portion of the inner wall radially outwardly; and flanging the open end while the container body remains in the working station.

In an eighth aspect of the present invention, a method is provided for reforming a container body having an outer wall that is disposed around a container axis, a bottom that is attached to the outer wall and that provides a supporting surface, a bottom recess portion that is disposed radially inwardly of the supporting surface and that includes an inner wall, and an open end distal from the bottom, which method comprises placing the container body in a working station; positioning a tooling element inside the bottom recess portion of the container body; providing relative transverse movement between the tooling element and the container body; using the tooling element to displace a portion of the inner wall radially outwardly; and necking the open end while the container body remains in the working station.

DESCRIPTION OF THE PREFERRED EMBODIMENTS

Referring now to FIGS. 1–4, these configurations are generally common to Pulciani et al. in U.S. Pat. Nos. 4,685,582 and 4,768,672, to a design manufactured by the assignee of the present invention, and to embodiments of the present invention.

Figure 3:
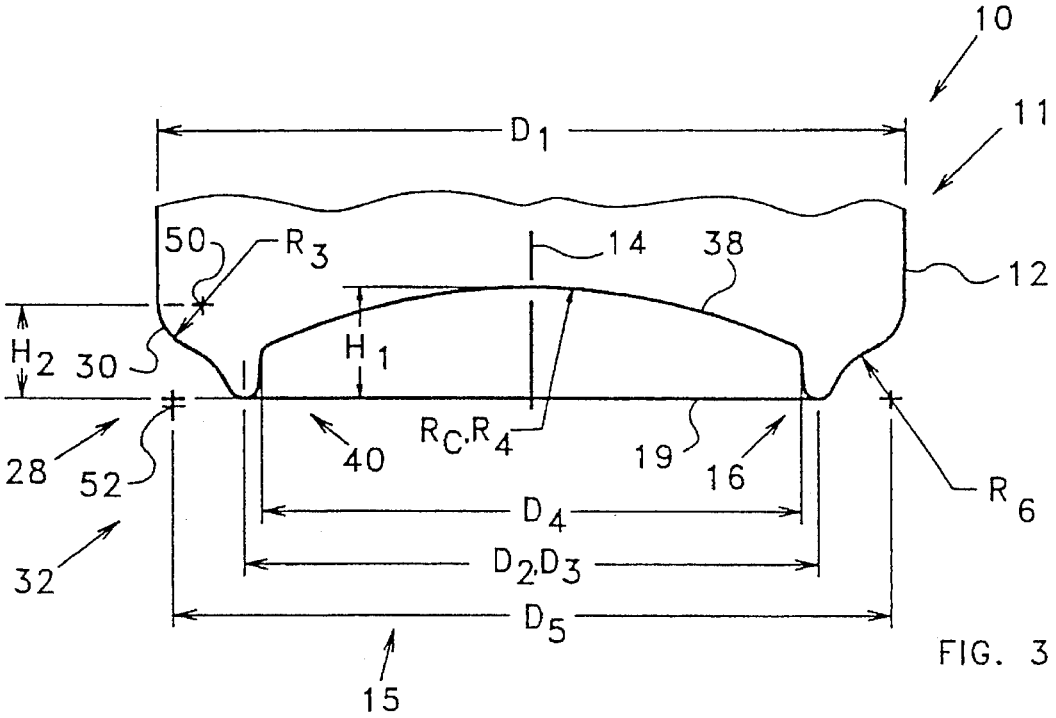
FIG. 3 is a cross sectional elevation of the lower portion of the container body of one of the beverage containers of FIGS. 1 and 2 showing details that are generally common to prior art designs and to embodiments of the present invention.
Figure 4:
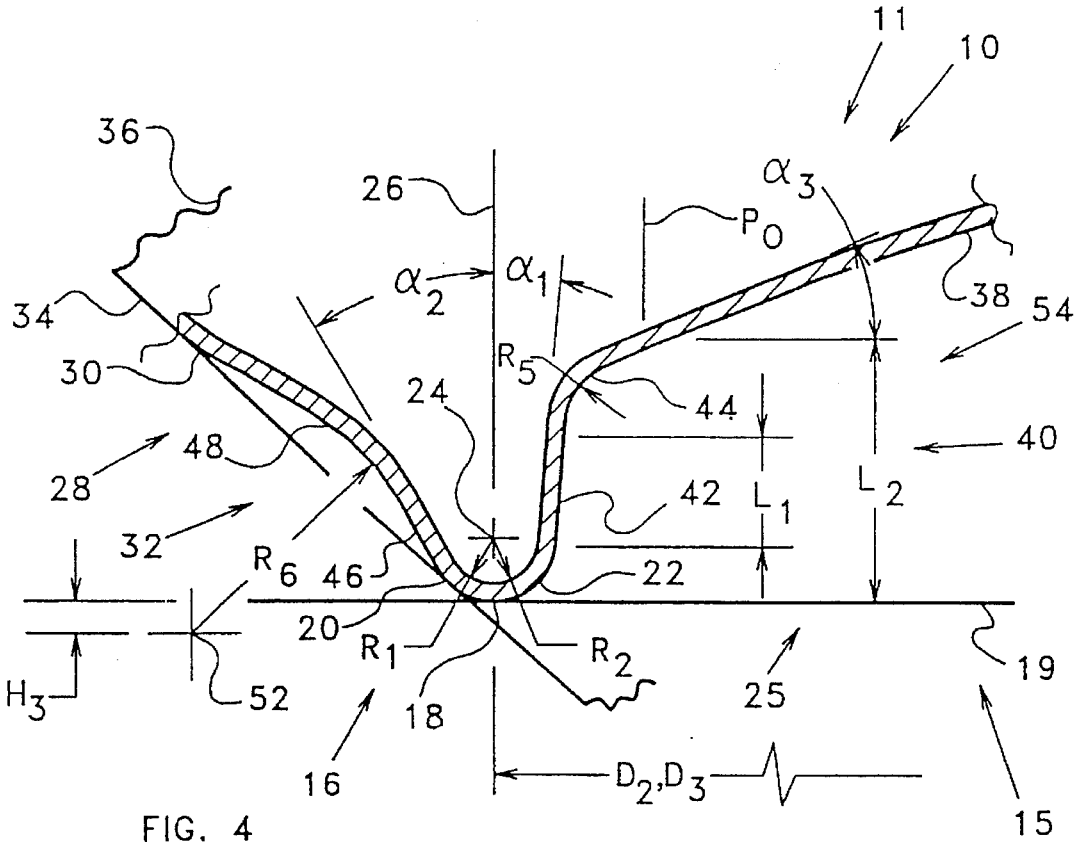
FIG. 4 is a cross sectional elevation showing, at an enlarged scale, details of the container body of FIG. 3.

More particularly, in the present invention, container bodies as generally shown in FIGS. 3 and 4 become embodiments of the present invention by being made to dimensions disclosed herein, and/or the bottom recess portions thereof being reworked as taught herein.

Referring now to FIGS. 1–4, a drawn and ironed beverage container 10 includes a container body 11 and a container closure 13. The container body 11 includes a bottom 15, a generally cylindrical sidewall 12 being connected to the bottom 15, having a first diameter $D_1$, and being disposed circumferentially around a container axis, or vertical axis, 14. The bottom 15 includes an annular supporting portion, or annular supporting means, 16 being disposed circumferentially around the container axis 14, being disposed radially inwardly from the sidewall 12, and providing an annular supporting surface 18 that coincides with a base line 19.

The annular supporting portion 16 includes an outer convex annular portion 20 that preferably is arcuate, and an inner convex annular portion 22 that preferably is arcuate, that is disposed radially inwardly from the outer convex annular portion 20, and that is connected to the outer convex annular portion 20. The outer and inner convex annular portions, 20 and 22, have radii $R_1$ and $R_2$ whose centers of curvature are common. More particularly, the radii $R_1$ and $R_2$ both have centers of curvature of a point 24, and of a circle of revolution 26 of the point 24. The circle of revolution 26 has a second diameter $D_2$.

The bottom 15 includes a bottom recess portion 25; and the bottom recess portion 25 includes the inner convex annular portion 22, a circumferential inner wall, or cylindrical inner wall, 42, an inner concave annular portion 44 and a center panel, or concave domed panel, 38.

An outer connecting portion, or outer connecting means, 28 includes an upper convex annular portion 30 that is preferably arcuate, that includes a radius of $R_3$, and that is connected to the sidewall 12. The outer connecting portion 28 also includes a recessed annular portion 32 that is disposed radially inwardly of a line 34, or a frustoconical surface of revolution 36, that is tangent to the outer convex annular portion 20 and the upper convex annular portion 30. Thus, the outer connecting means 28 connects the sidewall 12 to the outer convex annular portion 20.

The concave domed panel 38 is preferably spherically-shaped, but may be of any suitable curved shape, preferably has an approximate radius of curvature, or dome radius, $R_4$, is disposed radially inwardly from the annular supporting portion 16, and extends upwardly into the container body 11 when the container body 11 is in an upright position.

The container body 11 further includes an inner connecting portion, or inner connecting means, 40 having the inner wall 42 with a height $L_1$ that extends upwardly with respect to the container axis 14 that may be cylindrical, or that may be frustoconical and slope inwardly toward the container axis 14 at an angle $\alpha_1$. The inner connecting portion 40 also includes the inner concave annular portion 44 that has a radius of curvature $R_5$, and that interconnects the inner wall 42 and the domed panel 38. Thus, the inner connecting portion 40 connects the domed panel 38 to the annular supporting portion 16.

The inner connecting portion 40 positions a perimeter $P_0$ of the domed panel 38 at a positional distance $L_2$ above the base line 19. As can be seen by inspection of FIG. 4, the positional distance $L_2$ is approximately equal to, but is somewhat less than, the sum of the height $L_1$ of the inner wall 42, the radius of curvature $R_5$ of the inner concave annular portion 44, the radius $R_2$ of the inner convex annular portion 22, and the thickness of the material at the inner convex annular portion 22.

As seen by inspection and as can be calculated by trigonometry, the positional distance $L_2$ is less than the aforementioned sum by a function of the angle $\alpha_1$, and as a function of an angle $\alpha_3$ at which the perimeter $P_0$ of the domed panel 38 is connected to the inner concave annular portion 44.

For example, if the radius $R_5$ of the inner concave annular portion 44 is 0.050 inches, if the radius $R_2$ of the inner convex annular portion 22 is 0.040 inches, and if the thickness of the material at the inner convex annular portion 22 is about 0.012 inches, then the positional distance $L_2$ is about, but somewhat less than, 0.102 inches more than the height $L_1$ of the inner wall 42.

Thus, with radii and metal thickness as noted above, when the height $L_1$ of the inner wall 42 is 0.060 inches, the positional distance $L_2$ is about, but a little less than, 0.162 inches.

The annular supporting portion 16 has an arithmetical mean diameter $D_3$ that occurs at the junction of the outer convex annular portion 20 and the inner convex annular portion 22. Thus, the mean diameter $D_3$ and the diameter $D_2$ of the circle 26 are the same diameter. The dome radius $R_4$ is centered on the container axis 14.

The recessed annular portion 32 includes a circumferential outer wall 46 that extends upwardly from the outer convex annular portion 20 and outwardly away from the container axis by an angle $\alpha_2$, and includes a lower concave annular portion 48 with a radius $R_6$. Further, the recessed annular portion 32 may, according to the selected magnitudes of the angle $\alpha_2$, the radius $R_3$, and the radius $R_6$, include a lower part of the upper convex annular portion 30.

Finally, the container body 11 includes a dome height, or panel height, $H_1$ as measured from the supporting surface 18 to the domed panel 38, and a post diameter, or smaller diameter, $D_4$, of the inner wall 42. The upper convex annular portion 30 is tangent to the sidewall 12, and has a center 50. The center 50 is at a height $H_2$ above the supporting surface 18. A center 52 of the lower concave annular portion 48 is on a diameter $D_5$. The center 52 is below the supporting surface 18. More specifically, the supporting surface 18 is at a distance $H_3$ above the center 52.

Referring now to FIGS. 3 and 4, in the prior art embodiment of the three Pulciani, et al. patents, the following dimensions were used: $D_1$=2.597 inches; $D_2$, $D_3$=2.000 inches; $D_5$=2.365 inches; $R_1$, $R_2$=0.040 inches; $R_3$=0.200 inches; $R_4$=2.375 inches; $R_5$=0.050 inches; $R_6$=0.100 inches; and $\alpha_1$=less than 5°.

Referring now generally to FIGS. 5–11, container bodies 11 made generally according to the prior art configuration of FIGS. 3 and 4 can be reworked into container bodies 62 of FIGS. 5, 6, 9, 10, and 12, or can be reworked into container bodies 64 of FIGS. 7, 8, 11, and 13.

Referring now to FIGS. 5, 6, 9, and 10, the container body 62 includes a cylindrical sidewall 12 and a bottom 66 having an annular supporting portion 16 with an annular supporting surface 18. The annular supporting surface 18 is disposed circumferentially around the container axis 14, and is provided at the circle of revolution 26 where the outer convex annular portion 20 and the inner convex annular portion 22 join.

The bottom 66 includes a bottom recess portion 68 that is disposed radially inwardly of the supporting surface 18 and that includes both the concave domed panel 38 and a dome positioning portion 70.

Figure 9:
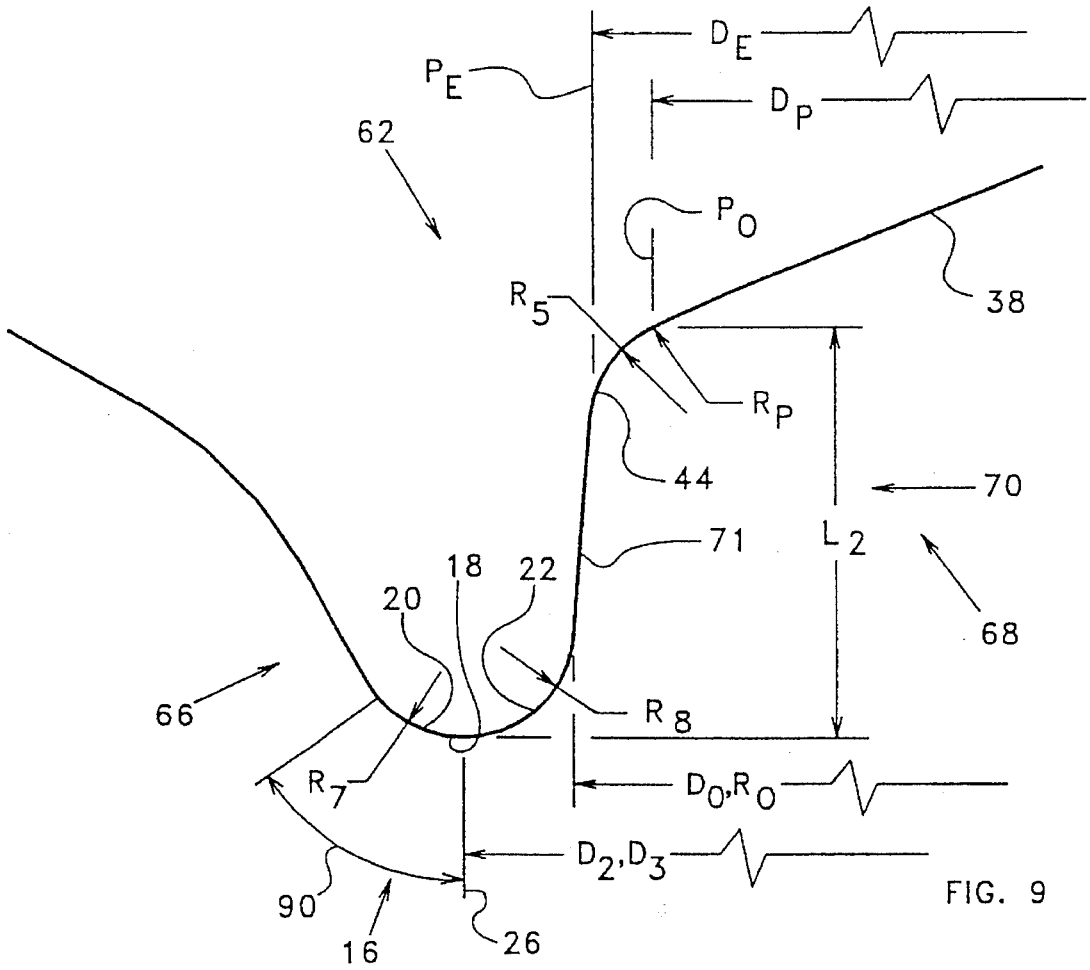
FIG. 9 is a partial and greatly enlarged outline of the outer contour of a container body, taken substantially as shown by section line 9—9 of FIG. 6, showing the bottom recess portion of the container body of FIGS. 5 and 6 in circumferential parts thereof that are not reworked in the embodiment of FIGS. 5 and 6, and showing the bottom recess portion of a container body prior to reworking into the container body of FIGS. 7 and 8.

It should be understood that the contour shown in FIG. 9, in addition to being representative of the circumferential parts of the container body 62 which are not reworked, is also representative of the container body 11 prior to reworking into either the container body 62 or the container body 64.

The dome positioning portion 70 disposes the concave domed panel 38 at the positional distance $L_2$ above the supporting surface 18. The dome positioning portion 70 includes the inner convex annular portion 22, an inner wall 71, and the inner concave annular portion 44.

Referring now to FIGS. 3 and 4, and more specially to FIG. 4, before reworking into either the container body 62 or the container body 64, the container body 11 includes a dome positioning portion 54. The dome positioning portion 54 includes the inner convex annular portion 22, the inner wall 42, and the inner concave annular portion 44.

Figure 5:
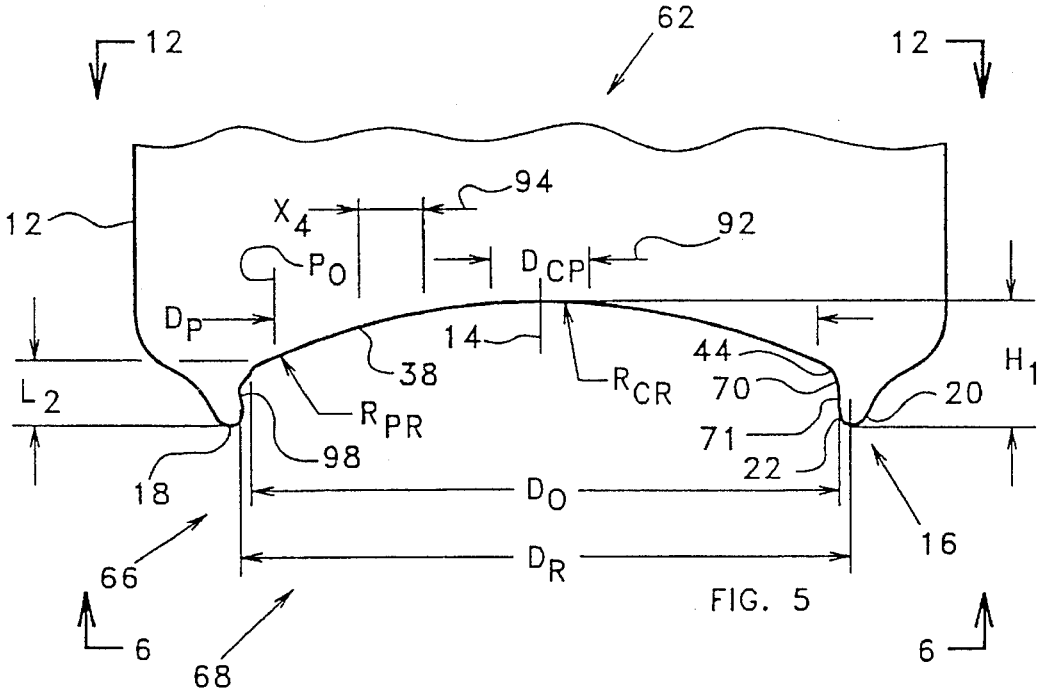
FIG. 5 is a partial and slightly enlarged outline, taken generally as a cross sectional elevation, of the outer contour of a container body of an embodiment of the present invention wherein a plurality of arcuately shaped and circumferentially-spaced parts of the inner sidewall are disposed radially outward of other parts of the sidewall.
Figure 6:
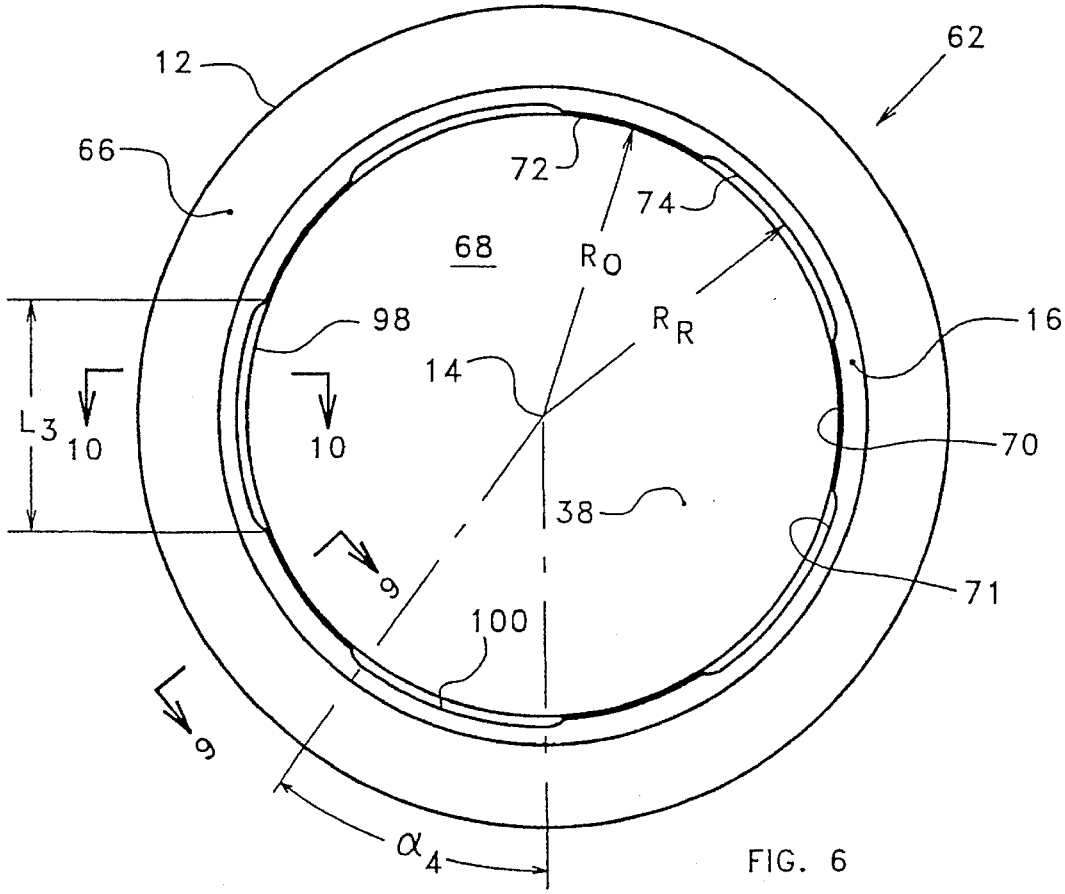
FIG. 6 is a bottom view of the container body of FIG. 5, taken substantially as shown by view line 6—6 of FIG. 5.
Figure 10:
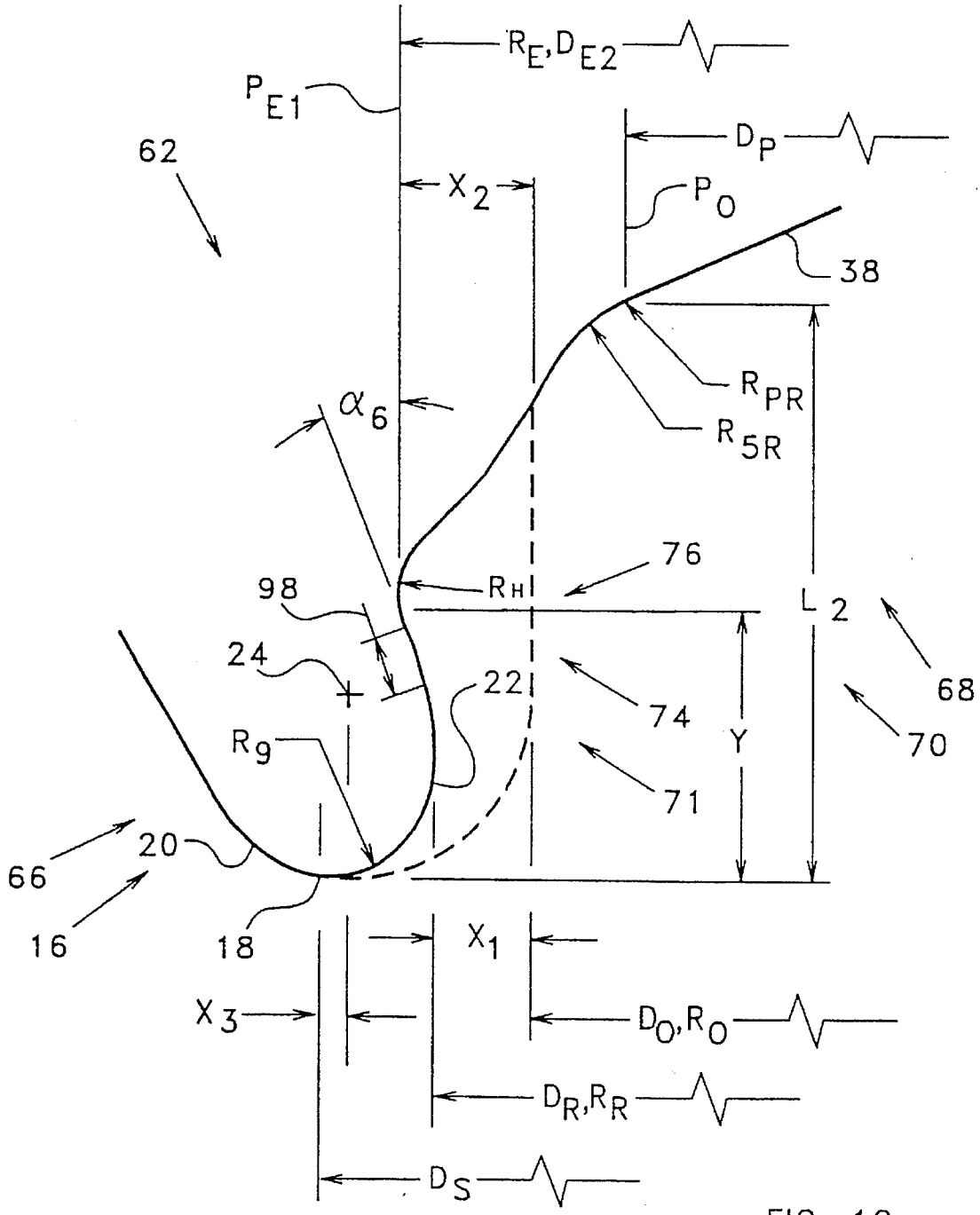
FIG. 10 is a partial and greatly enlarged outline of the outer contour of the container body of FIGS. 5 and 6, taken substantially as shown by section line 10—10 of FIG. 6, and showing the contour of circumferential parts of the bottom recess portion that are reworked in the embodiment of FIGS. 5 and 6.

Referring now to FIGS. 9 and 10, fragmentary and enlarged profiles of the outer surface contours of the container body 62 of FIGS. 5 and 6 are shown. That is, the inner surface contours of the container body 62 are not shown.

The profile of FIG. 9 is taken substantially as shown by section line 9—9 of FIG. 6 and shows the contour of the bottom 66 of the container body 62 in circumferential parts thereof in which the dome positioning portion 70 of the bottom recess portion 68 has not been reworked.

Referring again to FIGS. 5 and 6, the dome positioning portion 70 of the container body 62 includes a plurality of first parts 72 that are arcuately disposed around the circumference of the dome positioning portion 70 at a radial distance $R_0$ from the container axis 14 as shown in FIG. 6. The radial distance $R_0$ is one half of the inside diameter $D_0$ of FIGS. 9 and 10. The inside diameter $D_0$ occurs at the junction of the inner convex annular portion 22 and the inner wall 71. That is, the inside diameter $D_0$ is defined by the radially inward part of the inner convex annular portion 22.

The dome positioning portion 70 also includes a plurality of circumferentially-spaced adjacent parts 74 that are arcuately disposed around the dome positioning portion 70, that are circumferentially-spaced apart, that are disposed at a radial distance $R_R$ from the, container axis 14 which is greater than the radial distance $R_0$, and that are interposed intermediate of respective ones of the plurality of first parts 72, as shown in FIG. 6. The radial distance $R_R$ of FIG. 6 is equal to the sum of one half of the inside diameter $D_0$ and a radial distance $X_1$ of FIG. 10.

In a preferred embodiment of FIGS. 5 and 6, the adjacent parts 74 are 5 in number, each have a full radial displacement for an arcuate angle $\alpha_4$ of 30 degrees, and each have a total length $L_3$ of 0.730 inches.

Referring again to FIG. 9, in circumferential parts of the container body 62 of FIGS. 5 and 6 wherein the dome positioning portion 70 is not reworked, the mean diameter $D_3$ of the annular supporting portion 16 is 2.000 inches; and the inside diameter $D_0$ of the bottom recess portion 68 is 1.900 inches which is the minimum diameter of the inner convex annular portion 22. A radius $R_7$ of the outer contour of the outer convex annular portion 20 is 0.052 inches; and an outer radius $R_8$ of the inner convex annular portion 22 is 0.052 inches.

It should be noticed that the radii $R_7$ and $R_8$ are to the outside of the container body 62 and are therefore larger than the radii $R_1$ and $R_2$ of FIG. 4 by the thickness of the material.

Referring now to FIG. 10, in circumferential parts of the FIGS. 5 and 6 embodiments wherein the dome positioning portion 70 is reworked, a radius $R_9$ of the inner convex annular portion 22 is reduced, the inside diameter $D_0$ is increased by the radial distance $X_1$ to the inside diameter $D_R$, a hooked part 76 of the dome positioning portion 70 is indented, or displaced radially outward, by a radial dimension $X_2$, and the arithmetical mean diameter $D_3$ of the supporting portion 16 is increased by a radial dimension $X_3$ from the diameter $D_3$ of FIG. 9 to an arithmetical mean diameter $D_S$ of FIG. 10. The hooked part 76 is centered at a distance Y from the supporting surface 18 and includes a radius $R_H$.

Figure 7:
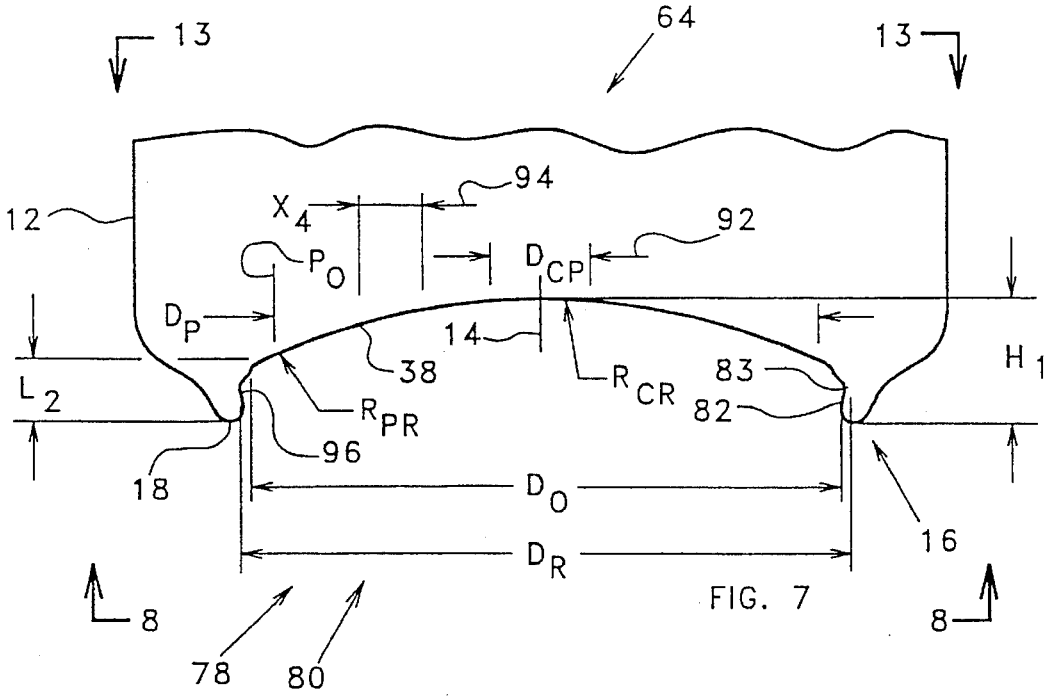
FIG. 7 is a partial and slightly enlarged outline, taken generally as a cross sectional elevation, of the lower portion of the outer contour of a container body made according to an embodiment of the present invention wherein a circumferential part of the inner sidewall is disposed radially outward of another circumferential part of the sidewall.
Figure 8:
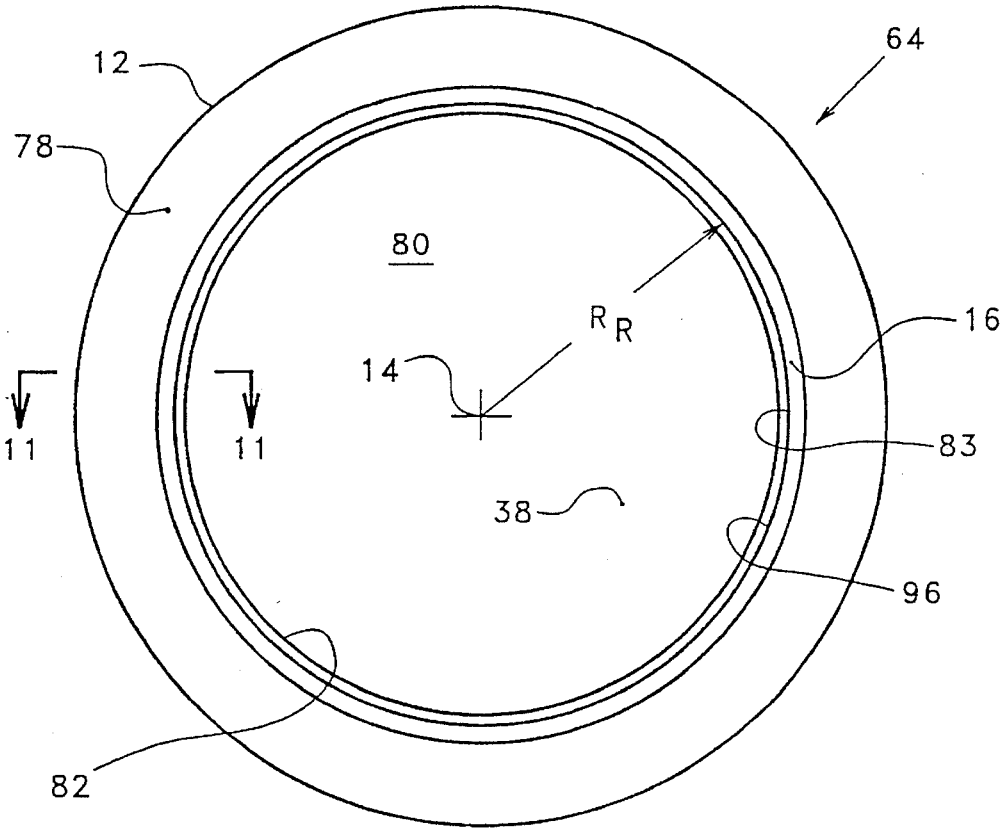
FIG. 8 is a bottom view of the container body of FIG. 7, taken substantially as shown by view line 8—8 of FIG. 7.
Figure 11:
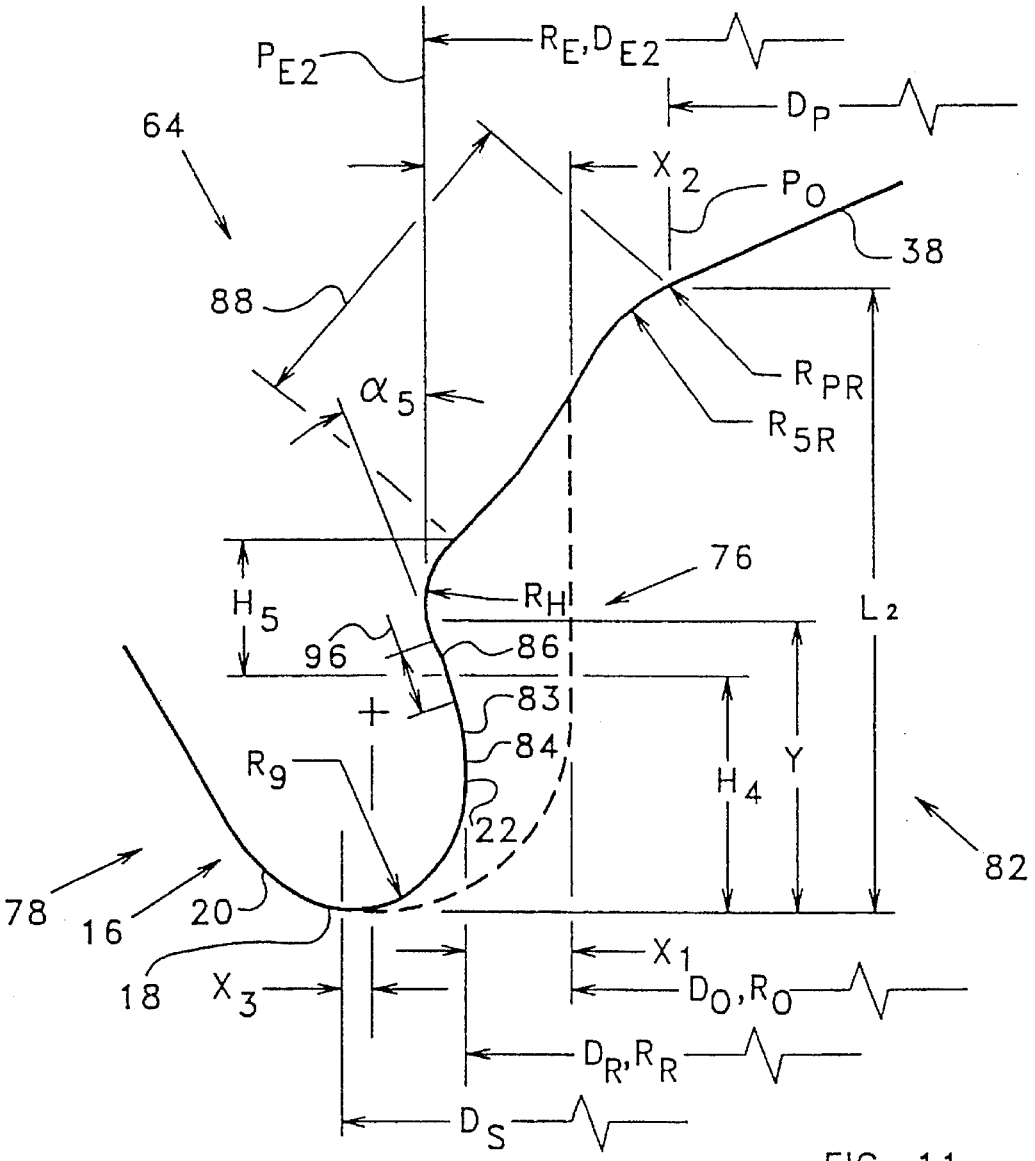
FIG. 11 is a partial and greatly enlarged outline of the outer contour of the container body of FIGS. 7 and 8, taken substantially as shown by section line 11—11 of FIG. 8, and showing the contour of the bottom recess portion as reworked in the embodiment of FIGS. 7 and 8.

Referring now to FIGS. 7, 8, and 11, the container body 64 includes the cylindrical sidewall 12 and a bottom 78 having the annular supporting portion 16 with the supporting surface 18. A bottom recess portion 80 of the bottom 78 is disposed radially inwardly of the supporting surface 18 and includes both the concave domed panel 38 and a dome positioning portion 82.

The dome positioning portion 82 disposes the concave domed panel 38 at the positional distance $L_2$ above the supporting surface 18 as shown in FIG. 11. The dome positioning portion 82 includes the inner convex annular portion 22, an inner wall 83, and the inner concave annular portion 44 as shown and described in conjunction with FIGS. 3 and 4.

The dome positioning portion 82 of the container body 64 includes a circumferential first part 84 that is disposed around the dome positioning portion 82 at the radial distance $R_R$ from the container axis 14 as shown in FIGS. 8 and 11. The radial distance $R_R$ is one half of the diameter $D_0$ of FIG. 11 plus the radial distance $X_1$. The diameter $D_0$ occurs at the junction of the inner convex annular portion 22 and the inner wall 42 of FIG. 4. That is, the diameter $D_0$ is defined by the radially inward part of the inner convex annular portion 22.

The dome positioning portion 82 also includes a circumferential adjacent part 86 that is disposed around the dome positioning portion 82, and that is disposed at an effective radius $R_E$ from the container axis 14 which is greater than the radial distance $R_R$ of the first part 84. The effective radius $R_E$ is equal to the sum of one half of the diameter $D_0$ and the radial dimension $X_2$ of FIG. 11. That is, the adjacent part 86 includes the hooked part 76; and the hooked part 76 is displaced from the radial distance $R_0$ by the radial dimension $X_2$. Therefore, it is proper to say that the adjacent part 86 is disposed radially outwardly of the first part 84.

Referring again to FIG. 9, prior to reworking, the mean diameter $D_3$ of the annular supporting portion 16 of the container body 64 is 2.000 inches; the inside diameter $D_0$ of the bottom recess portion 68 is 1.900 inches, which is the minimum diameter of the inner convex annular portion 22; and the radii $R_7$ and $R_8$ of the outer and inner convex annular portions, 20 and 22, are 0.052 inches.

Referring now to FIG. 11, the radius $R_9$ of the inner convex annular portion 22 is reduced, the diameter $D_0$ is increased by the radial distance $X_1$ to the diameter $D_R$, a hooked part 76 of the dome positioning portion 82 is indented, or displaced radially outward, by the radial dimension $X_2$, and the arithmetical mean diameter $D_3$ of both the supporting portion 16 and the supporting surface 18 of FIG. 9 is increased by the radial dimension $X_3$ to the diameter $D_S$ of FIG. 11. The hooked part 76 is centered at the distance Y from the supporting surface 18 and includes the radius $R_H$.

Figure 12:
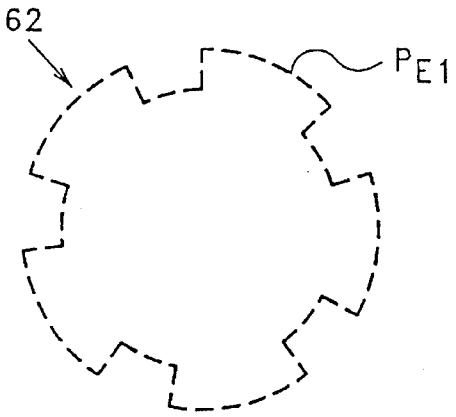
FIG. 12 is a fragmentary top view of the container body of FIGS. 5 and 6, taken substantially as shown by view line 12—12 of FIG. 5, and showing the effectively increased perimeter of the embodiment of FIGS. 5 and 6.
Figure 13:
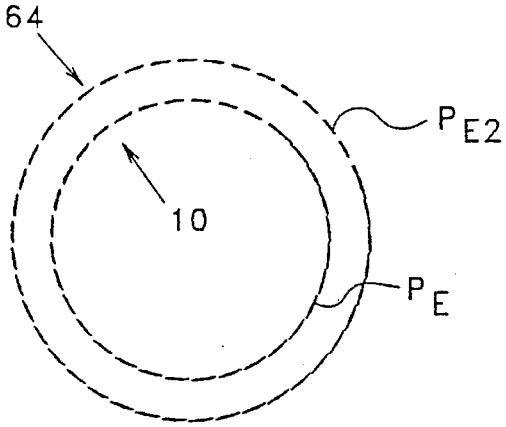
FIG. 13 is a fragmentary top view of the container body of FIGS. 7 and 8, taken substantially as shown by view line 13—13 of FIG. 7, and showing the effectively increased perimeter of the embodiment of FIGS. 7 and 8.

Referring now to FIGS. 4, 12, and 13, the concave domed panel 38 of the container body 11 of FIG. 4 includes the perimeter $P_0$ and an unreworked effective perimeter $P_E$ that includes the inner concave annular portion 44. However, when the container body 11 is reworked into the container body 62 of FIGS. 5 and 6, the domed panel 38 includes a reworked effective perimeter $P_{E1}$ which is larger than the perimeter $P_E$. In like manner, when the container body 11 of FIG. 4 is reworked into the container body 64 of FIGS. 7 and 8, the domed panel 38 includes a reworked effective perimeter $P_{E2}$ which is also larger than the unreworked effective perimeter $P_E$.

For testing, container bodies 11 made according to two different sets of dimensions, and conforming generally to the configuration of FIGS. 3 and 4, have been reworked into both container bodies 62 and 64.

Container bodies 11 made to one set of dimensions before reworking are designated herein as B6A container bodies, and container bodies 11 made according to the other set of dimensions are designated herein as B7 container bodies. The B6A and the B7 container bodies include many dimensions that are the same. Further, many of the dimensions of the B6A and B7 container bodies are the same as a prior art configuration of the assignee of the present invention.

Referring now to FIGS. 3, 4, and 9, prior to reworking, both the B6A container bodies and the B7 container bodies included the following dimensions: $D_1$=2.598 inches; $D_2$, $D_3$=2.000 inches; $D_5$=2.509 inches; $R_3$=0.200 inches; $R_5$=0.050 inches; $R_6$=0.200 inches; $R_7$ and $R_8$=0.052 inches; $H_2$=0.370 inches; $H_3$=0.008 inches; and $\alpha_2$=30 degrees. Other dimensions, including $R_4$, $H_1$, and the metal thickness, are specified in Table 1.

The metal used for both the B6A and B7 container bodies for tests reported herein was aluminum alloy which is designated as 3104 H19, and the test material was taken from production stock.

The dome radius $R_4$, as shown in Table 1, is the approximate dome radius of a container body 11; and the dome radius $R_4$ is different from the radius $R_T$ of the domer tooling. More particularly, as shown in Table 1, tooling with a radius $R_T$ of 2.12 inches produces a container body 11 with a radius $R_4$ of approximately 2.38 inches.

This difference in radius of curvature between the container body and the tooling is true for the three Pulciani et al. patents, for the prior art embodiments of the assignee of the present invention, and also for the present invention.

Referring now to FIGS. 3, 5, 7, and 9, the dome radius $R_4$ will have an actual dome radius $R_C$ proximal to the container axis 14, and a different actual dome radius $R_P$ at the perimeter $P_0$. Also, the radii $R_C$ and $R_P$ will vary in accordance with variations of other parameters, such as the height $L_1$ of the inner wall 71. Further, the dome radius $R_4$ will vary at various distances between the container axis 14 and the perimeter $P_0$.

The dome radius $R_C$ will be somewhat smaller than the dome radius $R_P$, because the perimeter $P_0$ of the concave domed panel 38 will spring outwardly. However, in the table the dome radius $R_4$ is given, and at the container axis 14, the dome radius $R_4$ is close to being equal to the actual dome radius $R_C$.

When the container bodies 11 are reworked into the container bodies 62 and 64, as shown in FIGS. 5 and 7, the dome radii $R_C$ and $R_P$, as shown on FIG. 3, may or may not change slightly with container bodies 11 made to various parameters and reworked to various parameters. Changed radii, due to reworking of the dome positioning portions, 70 and 82, as shown in FIGS. 10 and 11, are designated actual dome radius $R_{CR}$ and actual dome radius $R_{PR}$ for radii near the container axis 14 and near the perimeter $P_0$, respectively. However, since the difference between the dome radii $R_C$ and $R_P$ is small, and since the dome radii $R_C$ and $R_P$ change only slightly during reworking, if at all, only the radius $R_4$ of FIG. 3 is used in the accompanying table and in the following description.

Reworking of the dome positioning portions, 70 and 82, results in an increase in the radius $R_5$ of FIG. 4. To show this change in radius, the radius $R_5$, after reworking, is designated radius of curvature $R_{5R}$ in FIGS. 10 and 11 and in Table 1. As seen in Table 1, this change in the radius $R_5$ can be rather minimal, or quite large, depending upon various parameters in the original container body 11 and/or in reworking parameters.

When the change in the radius $R_5$ of FIG. 4 is quite large, as shown for the B7 container body reworked into the container body 64, reworking of the container body 11 into the container body 64 extends an effective diameter $D_E$ of the center panel 38, which includes the concave annular portion 44, and which is shown in FIG. 9, to an effective diameter $D_{E2}$, as shown in FIG. 11.

Therefore, in the reworking process, an annular portion 88 of the dome positioning portion 82, as shown in FIG. 11, is moved into, and affectively becomes a part of, the center panel 38.

Further, especially in the process in which the reworking is circumferential, as shown in FIGS. 7, 8, and 11, an annular portion 90, as shown in FIG. 9, of the bottom 78 which lies outside of the annular supporting surface 18, is moved radially inward, and effectively becomes a part of the dome positioning portion 82 of FIG. 11.

In Table 1, the static dome reversal pressure (S.D.R.) is in pounds per square inch, the cumulative drop height (C.D.H.) is in inches, and the internal pressure (I.P.) at which the cumulative drop height tests were run is in pounds per square inch.

The purpose for the cumulative drop height is to determine the cumulative drop height at which a filled can exhibits partial or total reversal of the domed panel.

The procedure is as follows: 1) warm the product in the containers to 90 degrees Fahrenheit, plus or minus 2 degrees; 2) position the tube of the drop height tester to 5 degrees from vertical to achieve consistent container drops; 3) insert the container from the top of the tube, lower it to the 3 inch position, and support the container with a finger; 4) allow the container to free-fall and strike the steel base; 5) repeat the test at heights that successively increase by 3 inch increments; 6) feel the domed panel to check for any bulging or "reversal" of the domed panel before testing at the next height; 7) record the height at which dome reversal occurs; 8) calculate the cumulative drop height, that is, add each height at which a given container has been dropped, including the height at which dome reversal occurs; and 9) average the results from 10 containers.

A control was run on both B6A and B7 container bodies 11 prior to reworking into the container bodies 62 and 64. In this control testing, the B6A container body had a static dome reversal pressure of 97 psi and the B7 container body had a static dome reversal pressure of 95 psi. Further, the B6A container body had a cumulative drop height resistance of 9 inches and the B7 container body had a cumulative drop height resistance of 33 inches.

TABLE 1

| | BODY 62 INTERRUPTED ANNULAR INDENT | | BODY 64 CONTINUOUS ANNULAR INDENT | |
|---|---|---|---|---|
| | B6A | B7 | B6A | B7 |
| $R_4$ | 2.38 | 2.038 | 2.38 | 2.038 |
| $R_T$ | 2.12 | 1.85 | 2.12 | 1.85 |
| $R_{5R}$ | — | — | 0.08 | 0.445 |
| $H_1$ | .385 | .415 | .385 | .415 |
| $D_R$ | 1.950 | 1.950 | 2.000 | 1.984 |
| $D_S$ | 2.020 | 2.020 | 2.051 | 2.041 |
| $R_H$ | .030 | .030 | .050 | .050 |
| $R_9$ | .030 | .030 | .026 | .026 |
| $X_1$ | .025 | .025 | .050 | .042 |
| $X_2$ | .054 | .051 | .055 | .055 |
| $X_3$ | .010 | .010 | .026 | .021 |
| Y | .084 | .086 | .076 | .092 |
| thkns. | .0116 | .0118 | .0116 | .0118 |
| I.P. | 58 | 59 | 58 | 59 |
| S.D.R. | 111 | 120 | 121 | 126 |
| C.D.H. | 10.8 | 30.0 | 18.0 | 60.0 |

Referring now to Table 1, when B6A container bodies were reworked into the container bodies 62, which have a plurality of circumferentially-spaced adjacent parts 74 that are displaced radially outwardly, the static dome reversal pressure increased from 97 psi to 111 psi, and the cumulative drop height resistance increased from 9 inches to 10.8 inches.

When the B7 container bodies were reworked into the container bodies 62, the static dome reversal pressure increased from 95 psi to 120 psi, and the cumulative drop height resistance decreased from 33 inches to 30 inches.

When the B6A container bodies were reworked into the container bodies 64, which have a circumferential adjacent part 86 that is displaced radially outwardly from a circumferential first part 84, the static dome reversal pressure increased from 97 psi to 121 psi, and the cumulative drop height resistance increased from 9 inches to 18 inches.

Finally, when the B7 container bodies were reworked into the container bodies 64, the static dome reversal pressure increased from 95 psi to 126 psi, and the cumulative drop height resistance increased from 33 inches to 60 inches.

Thus, B6A and B7 container bodies reworked into container bodies 62 of FIGS. 5 and 6 showed an improvement in static dome reversal pressure of 14.4 percent and 26.3 percent, respectively. B6A and B7 container bodies reworked into container bodies 62 showed an improvement in cumulative drop height resistance of 20 percent in the case of the B6A container body, but showed a decrease of 10 percent in the case of the B7 container body.

Further, B6A and B7 container bodies reworked into container bodies 64 of FIGS. 7 and 8 showed an improvement in static dome reversal pressure of 24.7 percent and 32.6 percent, respectively. B6A and B7 container bodies reworked into container bodies 64 showed an improvement in cumulative drop height resistance of 100 percent in the case of the B6A container body, and an increase of 81.8 percent in the case of the B7 container body.

Therefore, the present invention provides phenomenal increases in both static dome reversal pressure and cumulative drop height without increasing the size of the container body, without seriously decreasing the fluid volume of the container body as would be caused by increasing the height $L_1$ of the inner wall, 71 or 83, or by greatly decreasing the dome radius $R_4$ of the concave domed panel 38 of FIG. 3, and without increasing the thickness of the metal.

While reworking the B7 container bodies into the container bodies 62 did not show an increase in the cumulative drop height resistance, it is believed that this is due to two facts. One fact is that reworking of the container bodies 11 into the container bodies 62 and 64 was made without the benefit of adequate tooling. Therefore, the test samples were not in accordance with production quality. Another fact is that reworking the B7 container bodies into the container bodies 64 resulted in a greater radial distance $X_1$ than did the reworking of the B7 container bodies into the container bodies 62.

However, it remains a fact that reworking the B6A container bodies into the container bodies 64 did provide substantial increases in both the static dome reversal pressure and the cumulative drop height resistance.

It is believed that with further testing, parameters will be discovered which will provide additional increases in both static dome reversal pressure and cumulative drop height resistance.

Since the present invention provides a substantial increase in static dome reversal pressure, and with some parameters, a substantial increase in cumulative drop height resistance, it is believed that the present invention, when used with smaller dome radii $R_4$, or with center panel configurations other than spherical radii, will provide even greater combinations of static dome reversal pressures and cumulative drop height resistances than reported herein.

From general engineering knowledge, it is obvious that a dome radius $R_4$ that is too large would reduce the static dome reversal pressure. Further, it has been known that too small a dome radius $R_4$ would also reduce the static dome reversal pressure, even though a smaller dome radius $R_4$ should have increased the static dome reversal pressure.

While it is not known for a certainty, it appears that smaller values of dome radii $R_4$ placed forces on the inner wall 42 that were concentrated more directly downwardly against the inner convex annular portion 22, thereby causing roll-out of the inner convex annular portion 22 and failure of the container body 11.

In contrast, a larger dome radius $R_4$ would tend to flatten when pressurized. That is, as a dome that was initially flatter would flatten further due to pressure, it would expand radially and place a force radially outward on the top of the inner wall 42, thereby tending to prevent roll-out of the inner convex annular portion 22.

However, a larger dome radius $R_4$ would have insufficient curvature to resist internal pressures, thereby resulting in dome reversal at pressures that are too low to meet beverage producers requirements.

The present invention, by reworking the inner wall 42 of the container body 11 to the inner wall 71 of the container body 62, or by reworking the inner wall 42 to the inner wall 83 of the container body 64, increases in static dome reversal pressures that are achieved. These phenomenal increases in static dome reversal pressures are achieved by decreasing the force which tends to roll-out the inner convex annular portion 22.

More specifically, as seen in FIG. 11, in the instance of the container body 64 where the adjacent part 86 of the dome positioning portion 82 is circumferential, an effective diameter, which is the inside diameter $D_0$ of the bottom recess portion 25 of the container body 11, is increased to a diameter $D_{E2}$. The container body 64 also has an effective perimeter $P_{E2}$ as shown in FIG. 13.

Or, as seen in FIG. 10 which shows circumferentially-spaced adjacent parts 74 that are displaced outwardly, a radial distance $R_0$ of the domed panel 38 is increased to an effective radius $R_E$. An increase in the radial distance $R_0$ to the radius $R_E$ by the circumferentially-spaced adjacent parts 74 increases the effective perimeter of the domed panel 38 to perimeter $P_{E1}$ as shown in FIG. 12.

It can be seen by inspection of FIGS. 10 and 11 that placing the dome pressure force farther outwardly, as shown by the diameter $D_{E2}$ and the radius $R_E$, reduces the moment arm of the roll-out force. That is, the ability of a given force to roll-out the inner convex annular portion 22 depends upon the distance, radially inward, where the dome pressure force is applied. Therefore, the increase in the inside diameter $D_0$ to the effective diameter $D_{E2}$ of the container body 64, and the increase in the radial distance $R_0$ to the effective radius $R_E$, decrease the roll-out forces and thereby increase the resistance to roll-out.

Also, as shown in Table 1, the radius $R_9$ is reduced; and, from the preceding discussion, it can be seen that this reduction in radius also helps the container bodies 62 and 64 resist roll-out.

Continuing to refer to FIG. 11, the first part 84 of the container body 64 is circumferential and might be considered to have a height $H_4$, and the adjacent part 86 is also circumferential and might be considered to have a height $H_5$. That is, defining the heights, $H_4$ and $H_5$, is somewhat arbitrary. However, as can be seen, the adjacent part 86 is disposed radially outward from the first part 84; and the hooked part 76 of the dome positioning portion 82 is formed with the radius $R_H$.

Thus, in effect, after reworking into a container body 64, the dome positioning portion 82 is bowed outwardly at the distance Y from the supporting surface 18. This bowing outwardly of the dome positioning portion 82 is believed to provide a part of the phenomenal increase in static dome reversal pressure. That is, as the concave domed panel 38 applies a pressure-caused force downwardly, the outwardly-bowed dome positioning portion 82 tends to buckle outwardly elastically and/or both elastically and plastically.

As the dome positioning portion 82 tends to buckle outwardly, it places a roll-in force on the inner convex annular portion 22, thereby increasing the roll-out resistance.

That is, whereas the downward force of the concave domed panel 38 presses downwardly tending to unroll both the outer convex annular portion 20 and the inner convex annular portion 22, the elastic and/or elastic and plastic buckling of the dome positioning portion 82 tends to roll up the convex annular portions, 20 and 22.

In like manner, as shown in FIG. 10, in circumferential portions of the container body 62 which include the adjacent parts 74 and the hooked parts 76, the tendency of the dome positioning portion 70 to buckle outwardly is similar to that described for the dome positioning portion 82. However, since the hooked part 76 exists only in those circumferential parts of the dome positioning portion 70 wherein the adjacent parts 74 are located, the roll-in effect is not as great as in the container body 64.

Figure 14:
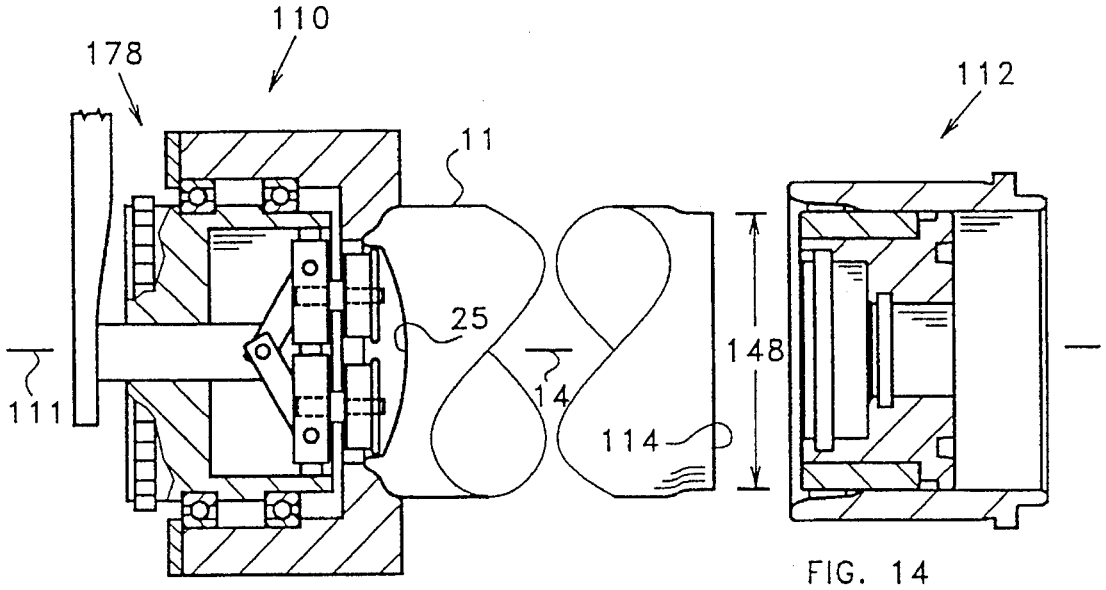
FIG. 14 is a cross sectional view of an embodiment of the present invention in which the container body remains stationary while rollers move both radially outward and in a planetary path to rework the bottom recess portion as shown in FIGS. 7, 8, and 11, and in which the open end of the container body is necked in a swaging operation that is coaxial with, and at least partially simultaneous with, the reworking of the bottom recess portion.
Figure 15:
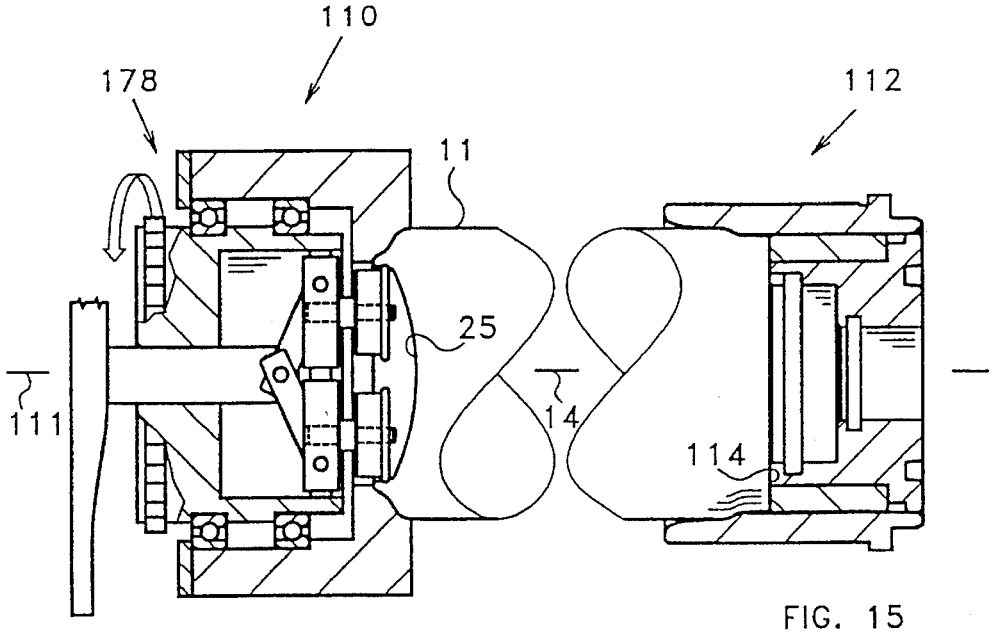
FIG. 15 is a cross sectional view of the embodiment of FIG. 14, taken substantially the same as FIG. 14, showing the bottom recess portion of the container body reworked, as shown in FIGS. 7, 8, and 11, in response to movement of the rollers radially outward and rotation of the rollers in a planetary path.
Figure 16:
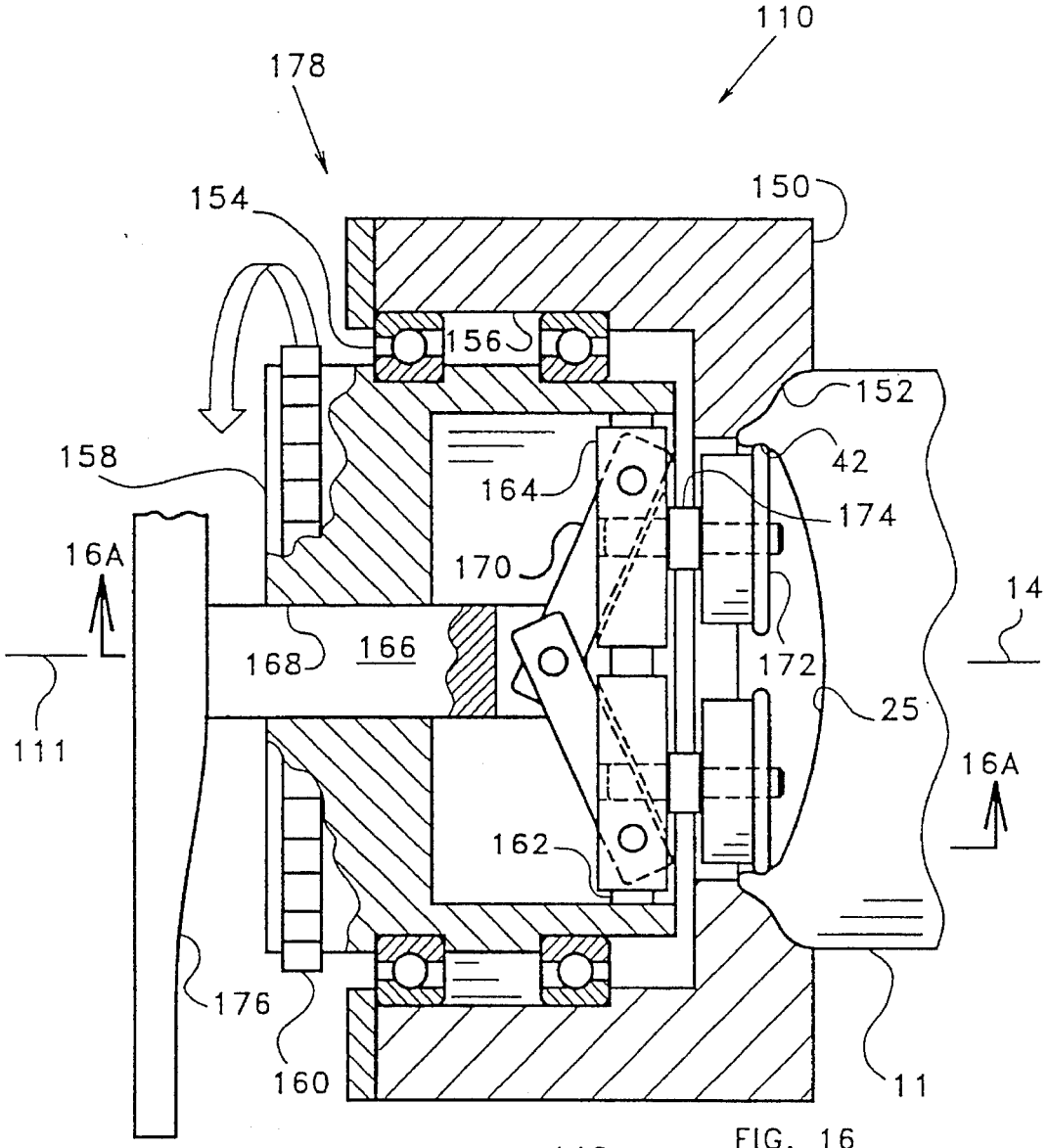
FIG. 16 is an enlarged cross section of the reforming apparatus of FIGS. 14 and 15, taken substantially the same as FIG. 15, and included herein to permit uncluttered numbering of parts.

Referring now to FIGS. 14–16, a recess-reforming apparatus 110 is disposed around a machine axis 111, and is provided for reforming the bottom recess portion 25 of a container body 11. In FIGS. 14 and 15, a second stage necking die 112 is disposed coaxial to the machine axis 111 and is included with the recess forming apparatus 110 so that an open end 114 of the container body 11 can be reworked while reworking the bottom recess portion 25. As shown in FIGS. 14 and 15, the container body 11 is positioned with the container axis 14 coaxial with the machine axis 111.

Figure 17:
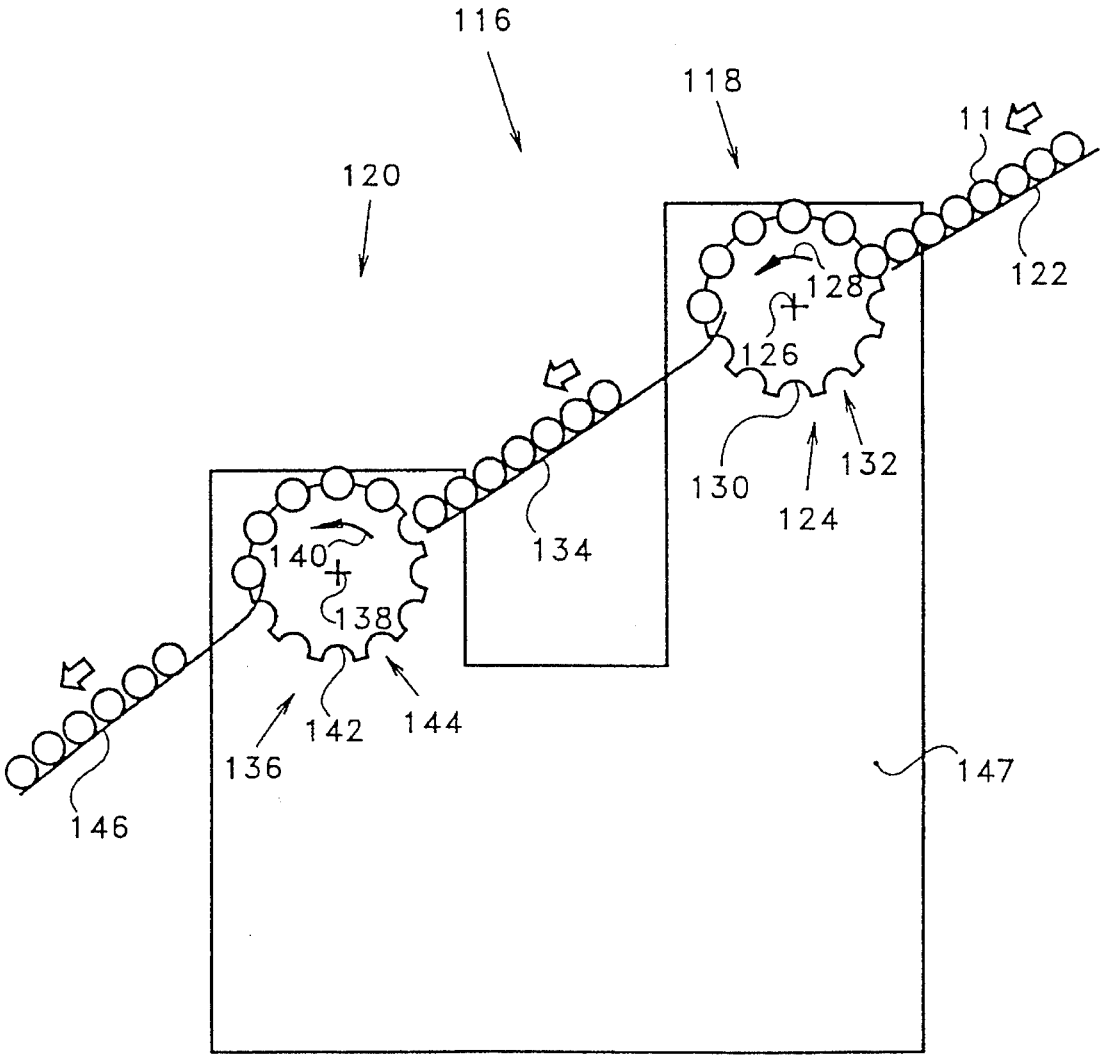
FIG. 17 is a schematic drawing showing the travel of the container body in a prior art necking machine with which the reforming apparatus of FIGS. 14–16 may be used, thereby accomplishing a necking operation of the open end of the container body at least partially simultaneous with the reworking of the bottom recess portion.

Referring now to FIGS. 14–17, the recess-reforming apparatus 110 and the necking die 112 are usable in conjunction with a prior art necking machine 116 which is shown in FIG. 17. The necking machine 116 includes a first necking stage 118 and a second necking stage 120. An infeed chute 122 feeds container bodies 11 to a first star wheel 124 in the first necking stage 118. The first star wheel 124 rotates in a counter-clockwise direction around a first star wheel axis 126, as shown by an arrow 128.

Sequential ones of the container bodies 11 are picked up from the infeed chute 122 by successive ones of infeed turret pockets 130 in the first star wheel 124. The first necking stage 118 includes twelve first working stations 132, as shown, each corresponding generally in location to one of the infeed turret pockets 130. Container bodies 11 remain in respective ones of the first working stations 132, and move rotationally with their respective ones of the first working stations 132, until discharged onto a transfer chute 134.

The transfer chute 134 delivers sequential ones of the container bodies 11 to a second star wheel 136 in the second necking stage 120. The second star wheel 136 rotates in a counter-clockwise direction around a second star wheel axis 138, as shown by an arrow 140. Sequential ones of the container bodies 11 are picked up from the transfer chute 134 by successive ones of second turret pockets 142 in the second star wheel 136. The second necking stage 120 includes twelve second working stations 144, as shown, each corresponding generally in location to one of the second turret pockets 142. The container bodies 11 remain in respective ones of the second working stations 144 until discharged onto a discharge chute 146.

The first and second star wheels, 124 and 136, are connected to a structural member 147 by means, not shown and not a part of the present invention.

The prior art necking machine 116 performs a first swaging operation on the open end 114 of respective ones of the container bodies 11 while the container bodies 11 are disposed in respective ones of the first working stations 132 of the first necking stage 118, thereby reducing a diameter 148 of the open end 114 of each container body 11.

Then, as the container bodies 11 are delivered to respective ones of the second working stations 144 in the second necking stage 120, the necking machine 116 performs a second swaging operation on the open ends 114 of respective ones of the container bodies 11 while the container bodies 11 are disposed in respective ones of the second working stations 144, thereby further reducing the diameter 148 of the open end 114 of each container body 11.

The necking dies 112 of FIGS. 14 and 15 are typical of those used with the necking machine 116 of FIG. 17, one of the necking dies 112 being made to first dimensions and being used in each of the second working stations 144, and similar dies, not shown, being made to somewhat different dimensions, and being used in each of the first working stations 132.

Preferably, the recess-reforming apparatus 110 is used in conjunction with the necking machine 116 of FIG. 17, one recess-reforming apparatus 110 being disposed in each of the second working stations 144. Thus, in the second working stations 144, a container body 11 is reworked into a container body 64 that includes a hooked part 76, as shown in FIG. 11; and the open end 114 of the container body 64 is reworked by one necking die 112 while the container body 64 is disposed in the same one of the second working stations 144.

Referring again to FIGS. 14–16, and more particularly to FIG. 16 wherein most of the part numbers are placed, the recess-reforming apparatus. 110 includes a stationary housing 150 having a can-receiving seat 152 that is disposed longitudinally to the machine axis 111, a pair of ball bearings 154 that are disposed in a bore 156 in the stationary housing 150, a rotating body 158 that is carried by the ball bearings 154, and a drive gear 160 that is integral with the rotating body 158.

Figure 16A:
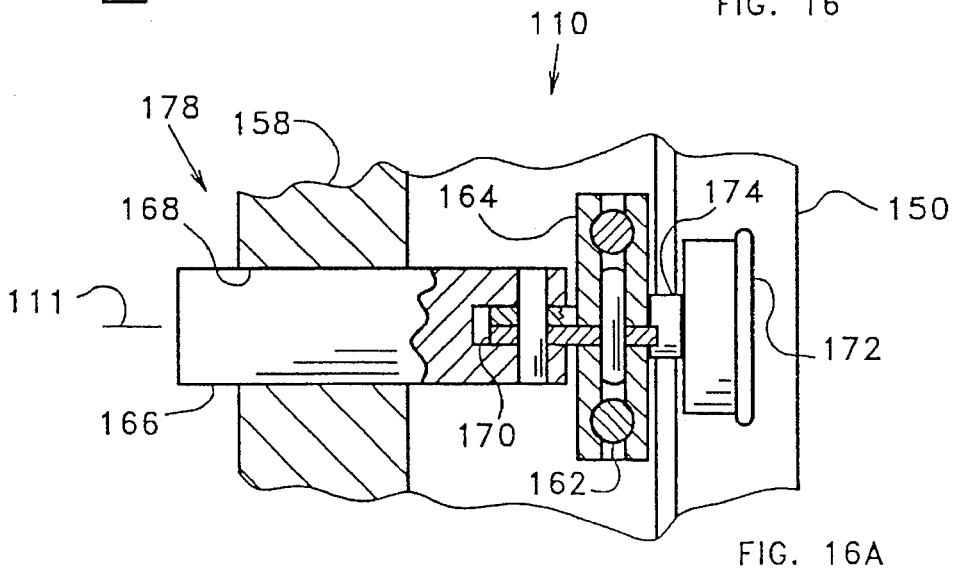
FIG. 16A is a partial cross section, taken substantially as shown by view line 16A—16A, and showing that the slide blocks are guided by two guide rods.

As shown in FIGS. 16 and 16A, a pair of guide rods 162 are fixedly secured in the rotating body 158. A pair of slide blocks 164 are slidably mounted onto the guide rods 162 so that the slide blocks 164 may move reciprocally transversely to the machine axis 111. An actuating shaft 166 is disposed in a hole 168 of the rotating body 158 and is movable longitudinally along the machine axis 111. Longitudinal movement of the actuating shaft, or tooling portion, 166 is translated into transverse movement of the slide blocks 164 by a pair of actuating links 170 that are pivotally attached to both the actuating shaft 166 and the slide blocks 164. A pair of tooling elements, or reforming rollers, 172 are mounted to respective ones of the slide blocks 164 by roller shafts 174.

The rotating body 158 is rotated by the drive gear 160, and a reforming cam 176 is moved transversely to the machine axis 111 by a mechanism, not shown, that is a part of the necking machine 116 of FIG. 17, thereby moving the actuating shaft 166 longitudinally along the machine axis 111; so that the reforming rollers 172 are moved transversely outward from one another as the actuating links 170 translate longitudinal movement of the actuating shaft 166 into transverse movement of the slide blocks 164.

Therefore, the container body 11 of FIGS. 3 and 4 is reformed into the container body 64 of FIGS. 7, 8, and 11 as the reforming cam 176 moves the actuating shaft 166 longitudinally, the actuating shaft 166 moves the actuating links 170, the actuating links 170 move the slide blocks 164, and the slide blocks 164 move the reforming rollers 172 into deforming contact with the inner wall 42 of the container body 11. That is, the actuating shaft 166 is one portion of the reforming apparatus 110, and movement of this one portion longitudinally results in transverse movement of the tooling elements, or reforming rollers, 172.

Finally, the recess-reforming apparatus 110 of FIGS. 16 and 16A includes a tooling device 178. The tooling device 178 includes the rotating body 158, the actuating shaft 166, the actuating links 170, the guide rods 162, the slide blocks 164, and the tooling elements 172.

Figure 18:
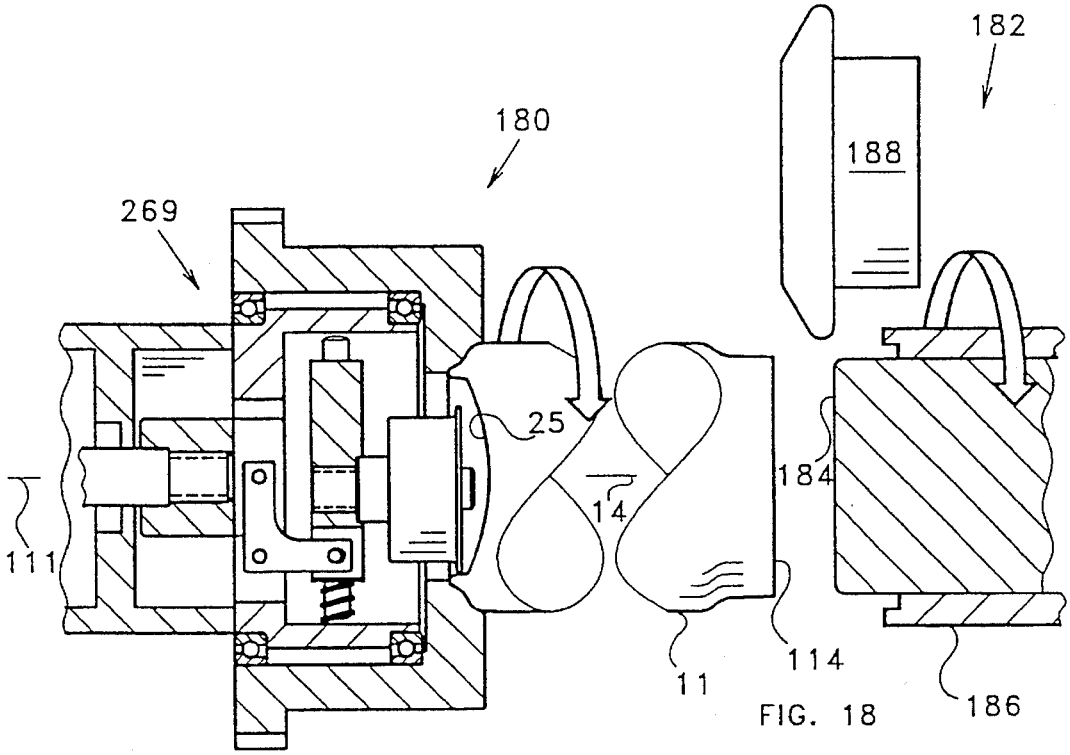
FIG. 18 is a cross sectional view of an embodiment of the present invention in which the container body rotates while a roller moves radially outward to rework the bottom recess portion as shown in FIGS. 7, 8, and 11, and in which the open end of the container body is flanged and/or necked in a spinning operation that is coaxial with the reworking of the bottom recess portion.
Figure 19:
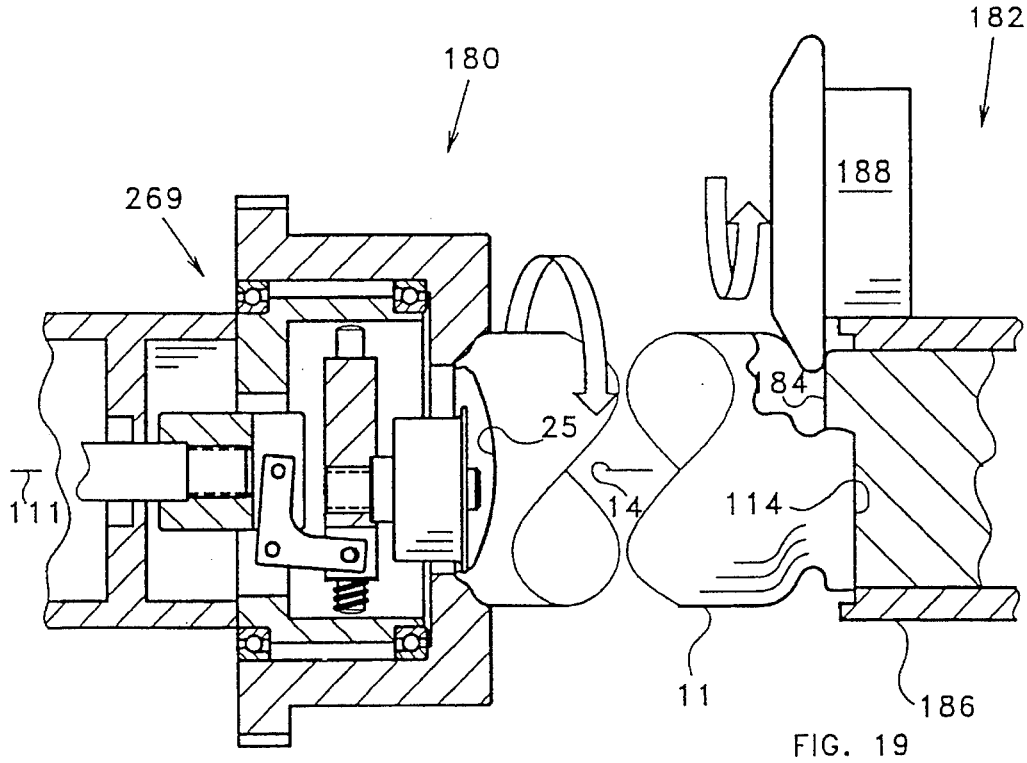
FIG. 19 is a cross sectional view of the reforming apparatus of FIG. 18, taken substantially the same as FIG. 18, showing the bottom recess portion of the container body reworked, as shown in FIGS. 7, 8, and 11, in response to rotation of the container body and movement of a roller radially outward.
Figure 20:
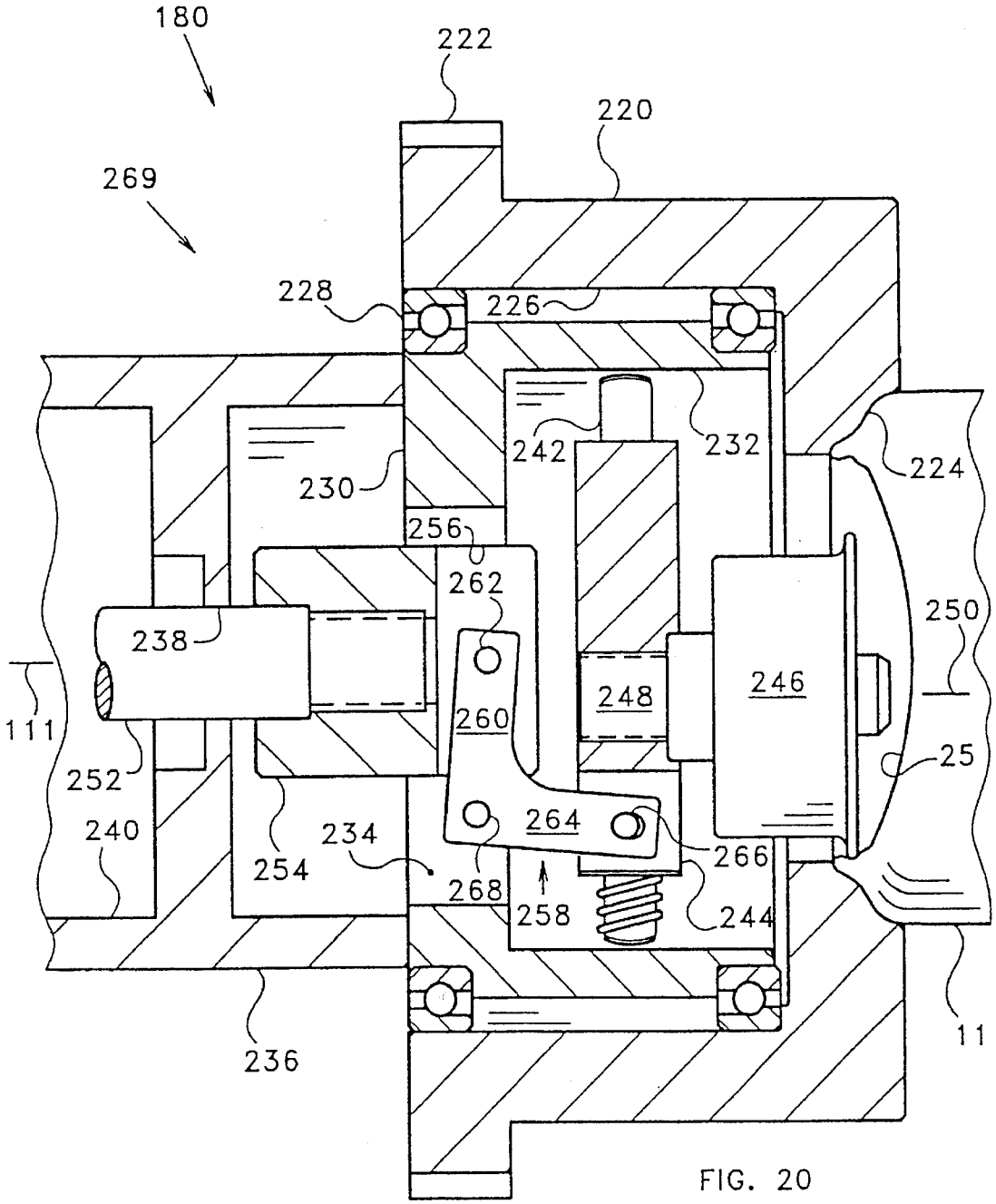
FIG. 20 is a partial and enlarged cross sectional view of the embodiment of FIGS. 18 and 19, taken substantially the same as FIG. 19, and included herein to permit uncluttered numbering of parts.

Referring now to FIGS. 18–20, a recess-reforming apparatus 180 is disposed around the machine axis 111, and is provided for reforming the bottom recess portion 25 of the container body 11. In FIGS. 18–19, a spin-forming apparatus 182 is disposed coaxial to the machine axis 111 and is included with the recess forming apparatus 180 so that an open end 114 of the container body 11 can be reworked while reworking the bottom recess portion 25. As shown in FIGS. 18 and 19, the container body 11 is positioned with the container axis 14 coaxial with the machine axis 111.

As shown in FIGS. 18 and 19, the spin-forming apparatus 182 includes a chuck 184, a control ring 186, and a necking disk 188 which work together to reform the open end 114 of the container body 11 by a spinning operation, thereby both necking the container body 11 and spin flanging the open end 114, which operations are a part of prior art technology.

Figure 21:
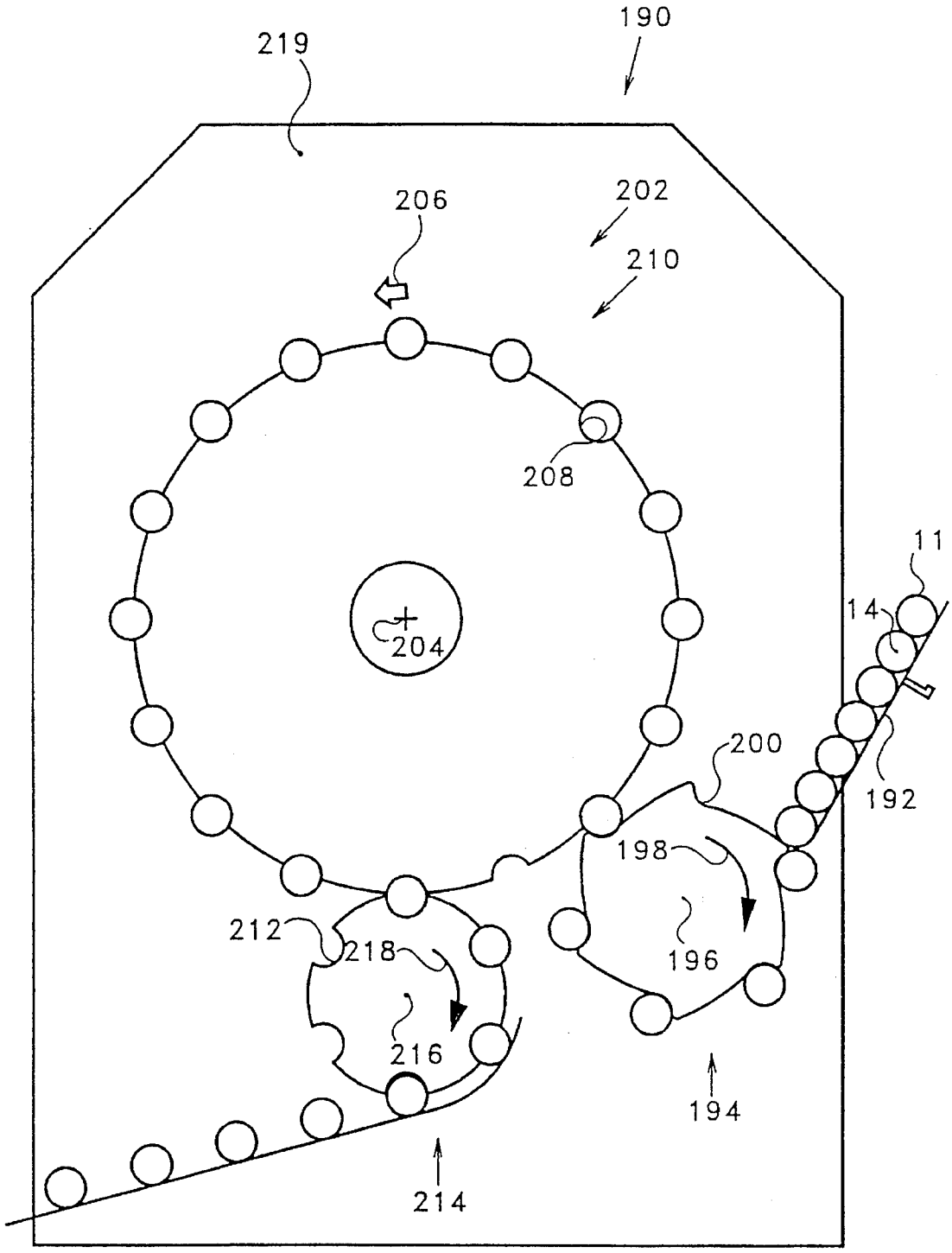
FIG. 21 is a schematic drawing showing the travel of a container body in a prior art spin-forming machine with which the embodiment of FIGS. 18–20 may be used, thereby flanging and/or necking the open end of the container body by a spinning operation that is at least partially simultaneous with the reworking of the bottom recess portion.

Referring now to FIGS. 18, 19, and 21, the recess-reforming apparatus 180 and the spin-forming apparatus 182 of FIGS. 18 and 19 are usable in conjunction with a prior art spin-forming machine 190 which is shown in FIG. 21.

Referring now to FIG. 21, the spin-forming machine 190 includes an infeed chute 192 in which container bodies 11 progress inwardly and downwardly with the container axes 14 thereof disposed horizontally. The infeed chute 192 feeds the container bodies 11 to a can-stop wheel 194. The can-stop wheel 194 rotates clockwise around an axis 196, as shown by an arrow 198. As the can-stop wheel 194 rotates, one container body 11 is picked up from the infeed chute 192 by successive ones of infeed turret pockets 200 in the can-stop wheel 194.

Successive ones of the container bodies 11 are rotated around the can-stop wheel 194 to a necking turret 202 which rotates in a counter-clockwise direction around an axis 204 as shown by an arrow 206. Container bodies 11 are delivered to successive ones of turret pockets 208 in the necking turret 202 by the can-stop wheel 194. The necking turret 202 includes sixteen working stations 210, each generally corresponding in location to the turret pockets 208. The container bodies 11 remain in respective ones of the working stations 210 as the necking turret 202 rotates.

In the spin-forming machine 190, the open ends 114, as shown in FIG. 18, of the container bodies 11 are necked and flanged by a spinning operation which is well known to container manufacturers. Then, successive ones of the container bodies 11 are removed from respective ones of the working stations 210 by respective ones of pick-off pockets 212 in a pick-off wheel 214 that rotates in a clockwise direction around an axis 216, as shown by an arrow 218.

The can-stop wheel 194, necking turret 202, and pick-off wheel 214 are connected to a structural member 219 by means, not shown and not a part of the present invention.

Since the spin-forming machine 190, the spin-forming apparatus 182, and the method are part of the prior art, and are well known to container manufacturers, a simple description as given above is sufficient to show how the present invention is used in combination with this prior art.

Referring now to FIG. 20, the recess-reforming apparatus 180 includes a housing 220 having a integral gear 222, having a container-receiving socket 224, and having a housing bore 226. The gear 222, the socket 224, and the housing bore 226 are all concentric with the machine axis 111. A pair of ball bearings 228 are pressed into the housing bore 226; and a reform body 230 is carried by the ball bearings 228. The reform body 230 includes a body bore 232 and a slot 234 that opens into the body bore 232.

A body extension 236 is attached to the reform body 230 by any suitable means, the particular attaching means not being a part of the present invention. The body extension 236 includes a shaft opening 238, and an extension bore 240 that is open to both the shaft opening 238 and the slot 234. The shaft opening 238 is concentric with the machine axis 111.

The recess-reforming apparatus 180 further includes a guide rod 242 that traverses the body bore 232, and that is attached to the reform body 230 at opposite sides of the body bore 232 in the same manner as shown for the guide rods 162 in FIG. 16A. A slide block 244 is slidably mounted onto the guide rod 242; and a tooling element, or reforming roller, 246 is attached to the slide block 244 by a roller shaft 248 with a roller axis 250 parallel to the machine axis 111.

An actuating shaft 252 is slidably inserted in the shaft opening 238 of the body extension 236. An actuating clevis 254 is screwed onto the actuating shaft 252 and includes a clevis slot 256. A bell crank 258 includes a first arm 260 that is inserted into the clevis slot 256 and that is pivotally attached to the actuating clevis 254 by a pin 262 that intercepts the actuating clevis 254 in the clevis slot 256 thereof. The bell crank 258 includes a second arm 264 that is pivotally attached to the slide block 244 by a pin 266. The bell crank 258 is pivotally attached to the reform body 230 inside the slot 234 by a pin 268; so that the first and second arms, 260 and 264, are pivotal around the pin 268.

In operation, the actuating shaft 252 is moved axially inward toward the container body 11 by a cam, not shown. Movement of the actuating shaft 252 axially inwardly is effective to move the actuating clevis 254 axially inwardly, thereby rotating the bell crank 258 in a clockwise direction around the pin 268. Movement of the bell crank 258 in a clockwise direction moves both the pin 266 and the slide block 244 radially, or transversely, outward from the machine axis 111, thereby moving the reforming roller 246 radially outward into deforming contact with the bottom recess portion 25 of the container body 11.

Finally, the recess-reforming apparatus 180 of FIG. 20 includes a tooling device 269. The tooling device 269 includes the reform body 230, the actuating shaft 252, the actuating clevis 254, the bell crank 258, the guide rod 242, the slide block 244, and the tooling element 246.

Figure 22:
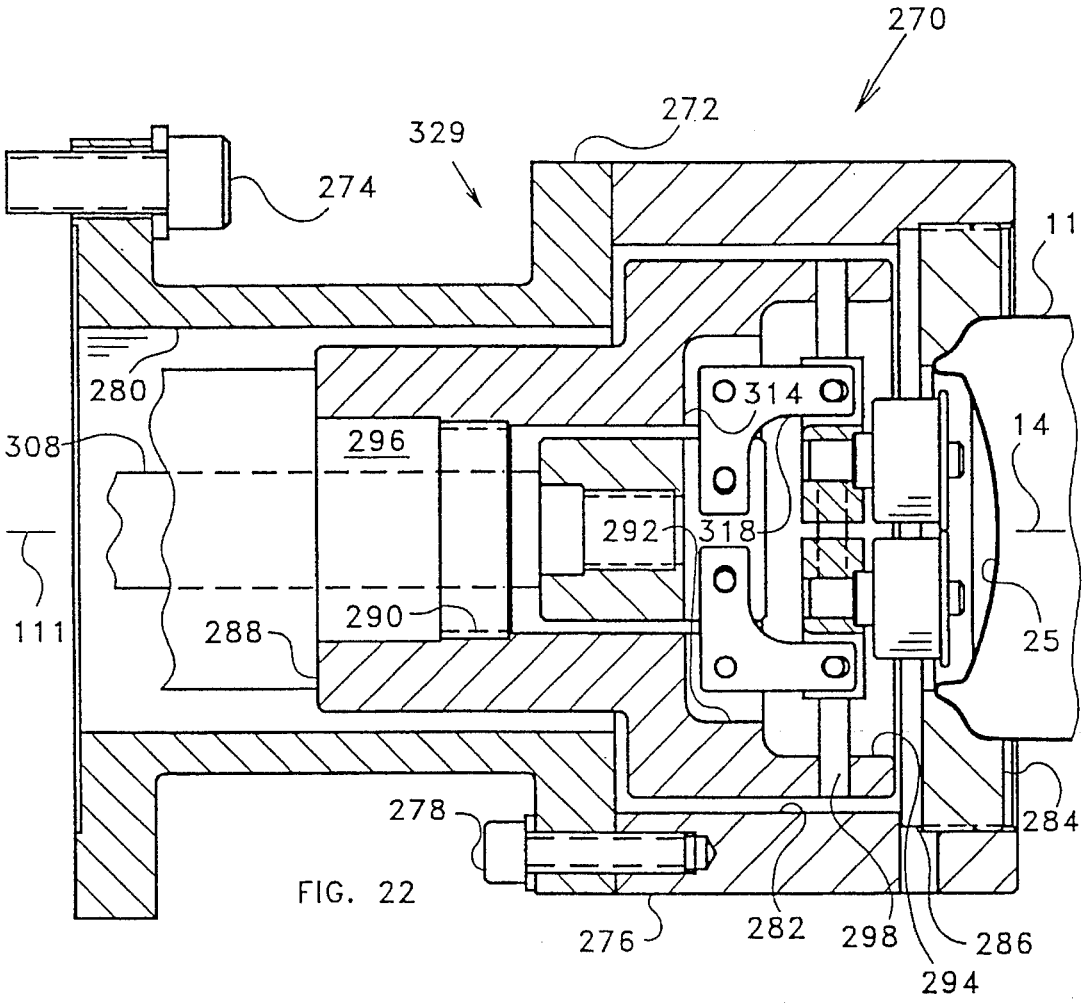
FIG. 22 is a cross sectional view of an embodiment of the present invention in which two rollers move radially outward in response to longitudinal movement of another portion of the tooling while the rollers rotate in a planetary path.

Referring now to FIG. 22 a recess-reforming apparatus 270 includes a flanged housing 272 that may be attached to a can-making machine, not shown, not a part of the present invention, by cap screws 274, and an extension housing 276 that is attached to the flanged housing 272 by cap screws 278. The flanged housing 272 includes a housing bore 280 that is concentric to the machine axis 111; and the extension housing 276 includes an auxiliary bore 282 that is concentric with the machine axis 111. A socket plate 284 includes a container-receiving socket 285 and is threaded into the auxiliary bore 282, and is locked into a desired longitudinal position by a threaded lock ring 286.

A reform body 288 includes a threaded bore 290, a slot 292 that opens into the threaded bore 290, and a large bore 294 that opens into the slot 292. The threaded bore 290 is threaded onto a tubular shafts, or tooling portion, 296 that is part of the afore-mentioned can-making machine.

A guide rod 298 extends transversely across the large bore 294, and is fixedly inserted in the reform body 288 at opposite sides of the large bore 294. A pair of slide blocks 300 are slidably fitted over the guide rod 298; and a pair of tooling elements, or reforming rollers, 302 are attached to respective ones of the slide blocks 300 by respective ones of roller shafts 304.

The can-making machine, not shown, includes an actuating shaft 308 with a threaded portion 310, and is inserted through the tubular shaft 296. An actuating clevis, or tooling portion, 312 of the recess-reforming apparatus 270 is threaded onto the threaded portion 310; and the actuating clevis 312 includes a clevis slot 316.

A pair of bell cranks 318 are pivotally attached to the reform body 288 in the slot 316 by respective ones of pins 320. The bell cranks 318 include first arms 322 that are disposed in the clevis slot 316, and that are pivotally attached to the actuating clevis 312 by respective ones of pins 324. Also, the bell cranks 318 include second arms 326 that are pivotally attached to respective ones of the slide blocks 300 by respective ones of pins 328.

In operation, the can-making machine, not shown, provides rotational motion to the tubular shaft 296, thereby rotating the reform body 288 together with the slide blocks 300 and the reforming rollers 302; so that the reforming rollers 302 move in a rotational path that is disposed radially outward from the machine axis 111, which is also the container axis 14 of the container body 11.

The can-making machine provides cam-actuated movement of the actuating shaft 308 longitudinally inward toward the container body 11. This longitudinally inward movement of the actuating shaft 308 moves the actuating clevis 312 longitudinally inward, moves the first arms 322 of the bell cranks 318 longitudinally inward, rotates the bell cranks 318 around respective ones of the pins 320, moves the slide blocks 300 transversely outward, or radially outward, one from the other, and moves the reforming rollers 302 into deforming engagement with the container body 11 at opposite sides of the bottom recess portion 25.

Figure 22A:
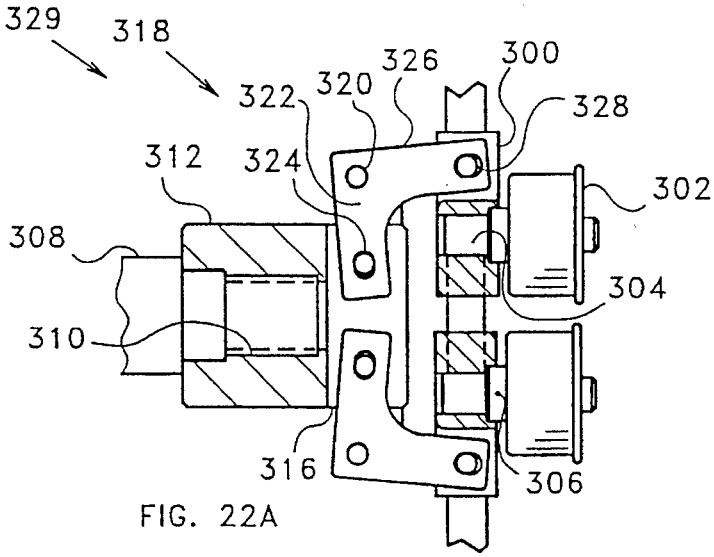
FIG. 22A is a partial cross sectional view of the embodiment of FIG. 22, taken substantially the same as FIG. 22, and showing the internal parts actuated to positions for reforming the bottom recess portion of a container.

Finally, the recess-reforming apparatus 270 of FIGS. 22 and 22A includes a tooling device 329. The tooling device 329 includes the tubular shaft 296, the reform body 288, the actuating shaft 308, the actuating clevis 312, the bell cranks 318, the guide rod 298, the slide blocks 300, and the tooling elements 302.

Figure 23:
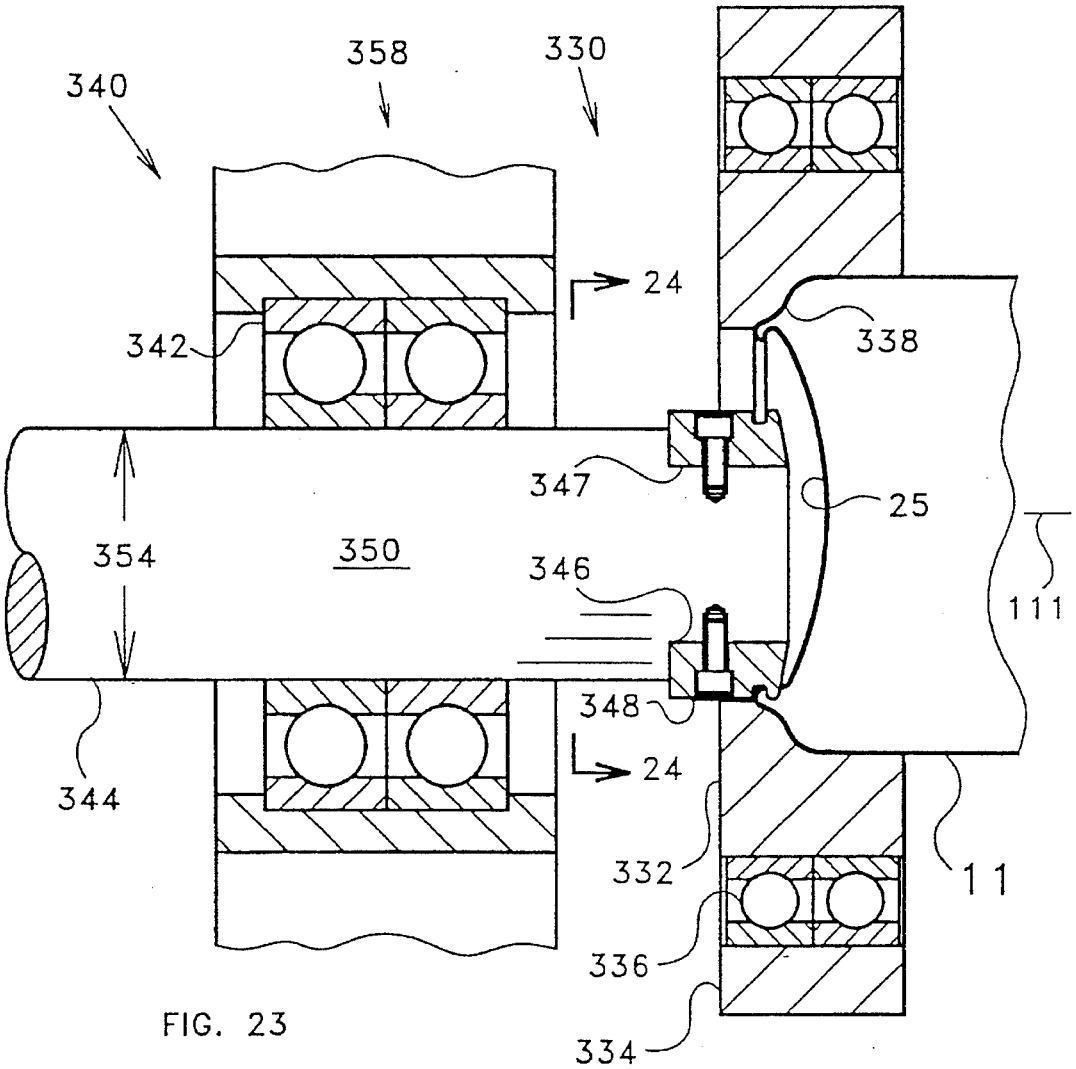
FIG. 23 is a cross sectional view of an embodiment of the present invention in which a container body and a roller rotate at a predetermined speed ratio, and in which projections that extend radially outward from the roller deform a plurality of parts of the bottom recess portion radially outward, as shown in FIGS. 5, 6, and 10, in response to transverse movement of the roller and rotation of both the container body and the roller.

Referring now to FIG. 23, a recess-reforming apparatus 330 includes a socket plate, or body, 332 that is attached to a frame member 334 by bearings 336 coaxial with the machine axis 111; and the socket plate 332 includes a container socket 338 that is coaxial to a machine axis 111.

The recess-reforming apparatus 330 further includes a cross slide 340 that is attached to the frame member 334 by any suitable means for movement transverse to the machine axis 111, the method of attachment not being a part of the present invention. Ball bearings 342 are mounted in the cross slide 340; and a reform shaft, or tooling portion, 344 is rotationally mounted in the ball bearings 342.

Figure 24:
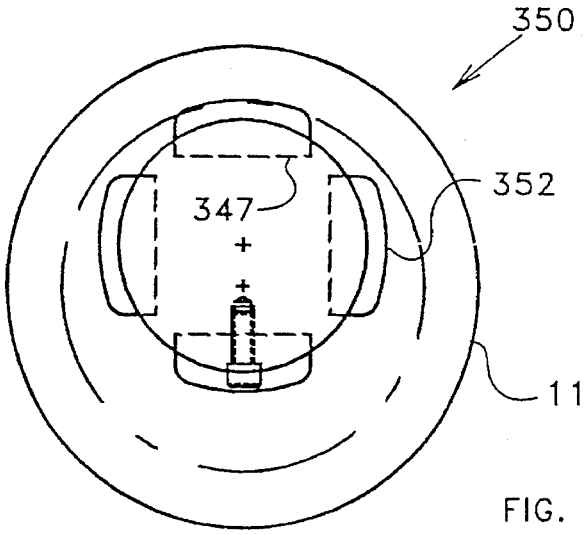
FIG. 24 is an end view of the embodiment of FIG. 23, taken substantially as shown by view line 24—24, showing the outwardly extending projections of the roller.

Referring now to FIGS. 23 and 24, four tooling elements 346 are inserted into sockets 347 of the reform shaft 344, and are attached to the reform shaft 344 by respective cap screws 348. Thus, the tooling elements 346 cooperate with the reform shaft 344 to provide a reforming roller 350 having a plurality of outwardly and radially extending and circumferentially-spaced apart projections 352 which are a part of the tooling elements 346.

As shown in the drawings, when the cross slide 340 is moved transversely, the projections 352 of the reforming roller 350 move radially outward into deforming contact with the bottom recess portion 25 of the container body 11. If the socket plate 332 and the container body 11 are allowed to rotate freely, and if the reforming roller 350 has an effective diameter 354 that is a predetermined ratio of the diameter $D_0$ of the bottom recess portion 25 of the container body 11, then respective ones of the tooling elements 346 will cooperate with others of the tooling elements 346 to progressively form a plurality of negatively-sloping parts, or arcuately shaped and circumferentially-spaced parts, 100 of the bottom recess portion 25 that are deformed radially outward, as shown in FIGS. 5 and 6.

Further, if the socket plate 332 and the container body 11 are made to rotate at a predetermined speed ratio with the reforming roller 350 by any suitable mechanism, not a part of the present invention, then tracking of the tooling elements 346 with the circumferentially-spaced parts 100 is assured.

Finally, the recess-reforming apparatus 330 of FIGS. 23 and 24 includes a tooling device 358. The tooling device 358 includes the cross slide 340 which serves as a body, the ball bearings 342, the reform shaft 344 and the tooling elements 346 which combine to form the reforming roller 350.

Figure 25:
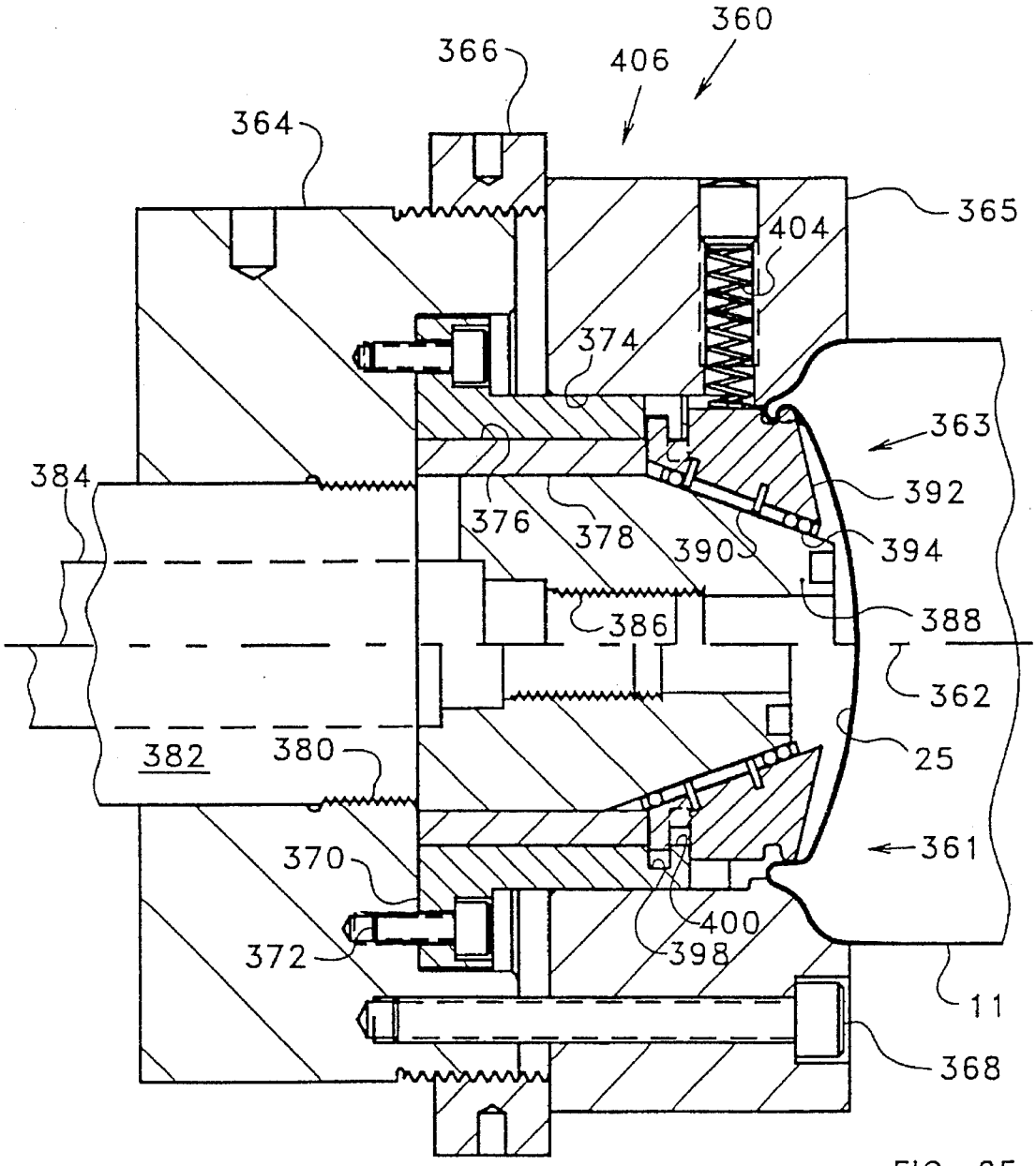
FIG. 25 is a cross sectional view of an embodiment of the present invention showing a half section in which a plurality of tooling elements are in the retracted positions, and showing another half section in which the tooling elements are moved radially outward in response to longitudinal movement of another portion of the tooling to swage a plurality of parts of the bottom recess portion radially outward as shown in FIGS. 5, 6, and 10.

Referring now to FIG. 25, a recess-reforming apparatus 360 is shown with a half section 361 thereof being disposed below a section line 362, and with a half section 363 being disposed above the section line 362. The half section 361 shows the reforming apparatus 260 in its unactuated state; and the half section 363 shows the reforming apparatus 360 actuated to its swaging state.

Figure 25A:
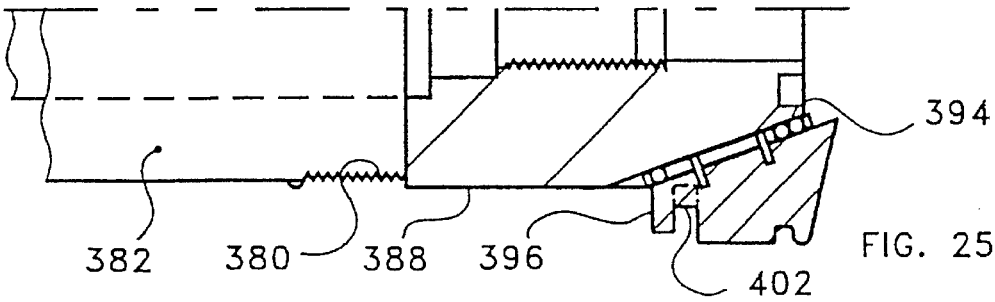
FIG. 25A is a half section of the embodiment of FIG. 25, taken substantially as shown in FIG. 25, and included herein to permit uncluttered numbering of parts.

Referring now to FIG. 25A, internal parts of the half section 361 of FIG. 25 have been reproduced in FIG. 25A to permit uncluttered numbering of the various parts thereof.

Referring now to FIGS. 25 and 25A, the recess-reforming apparatus 360 includes a head receptacle 364 and a container receptacle 365. The container receptacle 365 includes a container socket 367 and is spaced apart from the head receptacle 364 by a threaded adjusting ring 366 that is threaded onto the head receptacle 364; and the container receptacle 365 is attached to the head receptacle 364 by cap screws 368.

A flanged guide sleeve 370 is attached to the head receptacle 364 by cap screws 372, extends longitudinally into a bore 374 of the container receptacle 365, and includes a bearing bore 376. A sleeve bearing 378 is pressed into the bearing bore 376.

The head receptacle 364 is attached to a can-making machine, not shown, by a threaded end 380 of a tubular shaft, or tooling portion, 382 of the can-making machine. An actuating shaft 384 of the can-making machine is slidably inserted through the tubular shaft 382 and includes a threaded portion 386.

A swaging head 388 is screwed onto the threaded portion 386 and includes a plurality of camming flats 390. A plurality of tooling elements, or circumferentially-spaced apart swaging elements, 392 are positioned proximal to respective ones of the camming flats 390, and respective ones of slide bearings 394 are disposed between respective ones of the camming flats 390 and the swaging elements 392.

Longitudinal movement of the swaging elements 392 is prevented by engagement of tongues 396 of the swaging elements 392 engaging an internal groove 398 of the flanged guide sleeve 370, and by an inwardly extending flange 400 of the flanged guide sleeve 370 engaging respective ones of external grooves 402 of the swaging elements 392.

In operation, as shown by the half section 363, movement of the actuating shaft 384 longitudinally inward moves the swaging elements 392 radially outward in response to engagement of the camming flats 390 through the slide bearings 394, thereby swaging a plurality of circumferentially-spaced parts 100 of the bottom recess portion 25 of the container body 11 radially outward, to form a container body 62, as shown in FIGS. 5 and 6.

Then, when the actuating shaft 384 is moved longitudinally away from the reformed container body 62, a plurality of springs 404 move respective ones of the swaging elements 392 radially inward; so that the reformed container body 62 can be removed from the recess-reforming apparatus 360; and so that the bottom recess portion 25 of another container body 11 can be positioned around the swaging elements 392.

Referring now to FIGS. 14–25, in the recess-reforming apparatus 110 of FIGS. 14–16, the reforming rollers 172 rotate in a path that is disposed radially outward of the container axis 14; and the reforming rollers 172 are moved radially outward into deforming engagement with the bottom recess portion 25 of a container body 11, while the container body 11 remains rotationally motionless.

Since the container body 11 remains rotationally motionless, the recess-reforming apparatus 360 of FIG. 25 could be substituted for the recess-reforming apparatus 110 of FIGS. 14–16. Further, either the recess-reforming apparatus 110 of FIGS. 14–16, or the recess-reforming apparatus 360 of FIG. 25 could be used in conjunction with either or both of the working stations, 132 or 144, of the necking machine 116 of FIG. 17.

Further, even though the reforming apparatus 110 of FIGS. 14–16 has been shown in conjunction with a non-rotating container body 11, the reforming apparatus 110 of FIGS. 14–16 is equally suitable for use with a machine, such as the spin-forming machine 190 of FIG. 21 in which the container body 11 rotates.

Referring again to FIGS. 18–20, although a single reforming roller 246 has been shown and described in conjunction with a single bell crank 258 and a single slide block 244, the mechanism as described in conjunction with FIG. 22, wherein two reforming rollers 302 are used, could be substituted for the mechanism as described in FIGS. 18–20.

Further, although only one guide rod, 242 or 298 has been shown in the embodiments of FIGS. 20 and 22, this has been done for the purpose of avoiding undue complexity in drawings and descriptions. It should be understood that two guide rods, such as the guide rods 162 of FIGS. 16 and 16A could be used in the embodiments of FIGS. 20 and 22. However, if it is assumed that the guide rods 242 and 298 of FIGS. 20 and 22, respectively, are rectangular in cross section, then this cross sectional shape will prevent rotation of the slide blocks, 244 and 300, around the respective ones of their guide rods, 242 or 298, and the use of two guide rods, 242 or 298, becomes unnecessary.

Finally, the recess-reforming apparatus 360 of FIGS. 25 and 25A includes a tooling device 406. The tooling device 406 includes the head receptacle 364 which cooperates with the flanged guide sleeve 370 to serve as a body 408, the tubular shaft 382, the actuating shaft 384, the swaging head 388, and the tooling elements 392.

Figure 26:
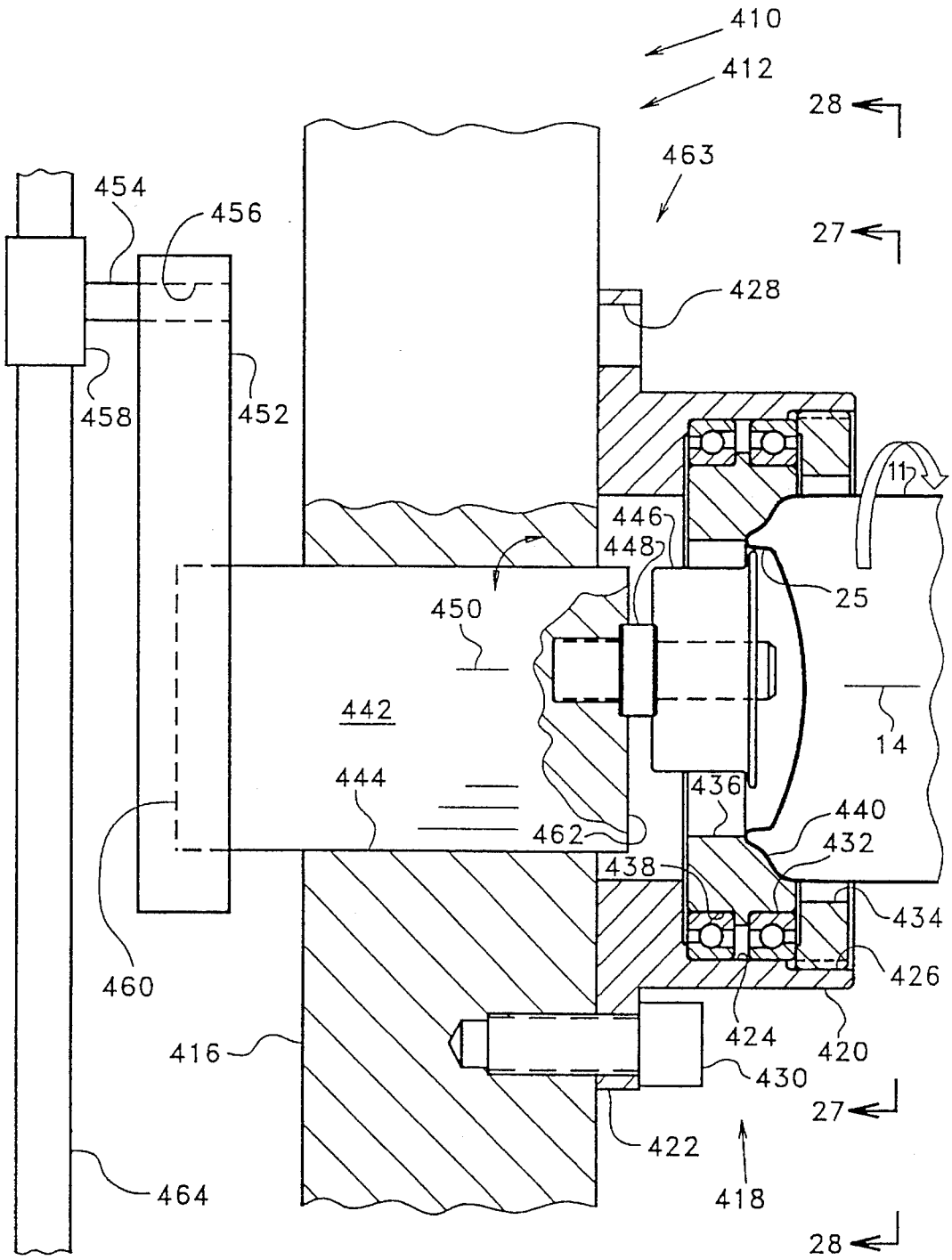
FIG. 26 is a cross sectional view of an embodiment of the present invention wherein the container body rotates, and an eccentrically mounted roller is moved transversely outwardly in response to rotational positioning of a portion of the tooling device by a cam.
Figure 27:
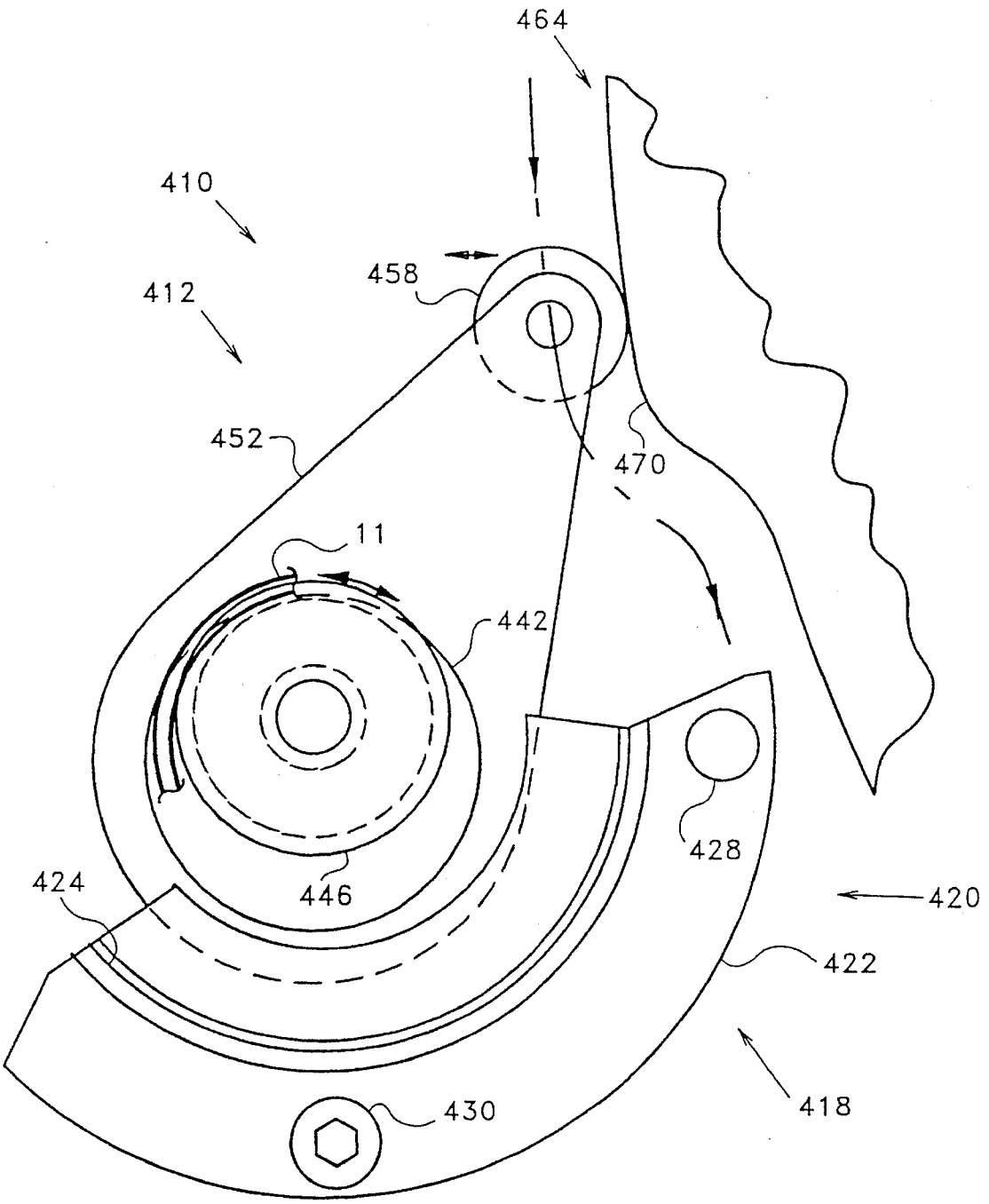
FIG. 27 is a partial end view of the embodiment of FIG. 26, taken substantially as shown by view line 27—27, but with the turret drum removed to show the cam, cam follower, and pivot arm.
Figure 28:
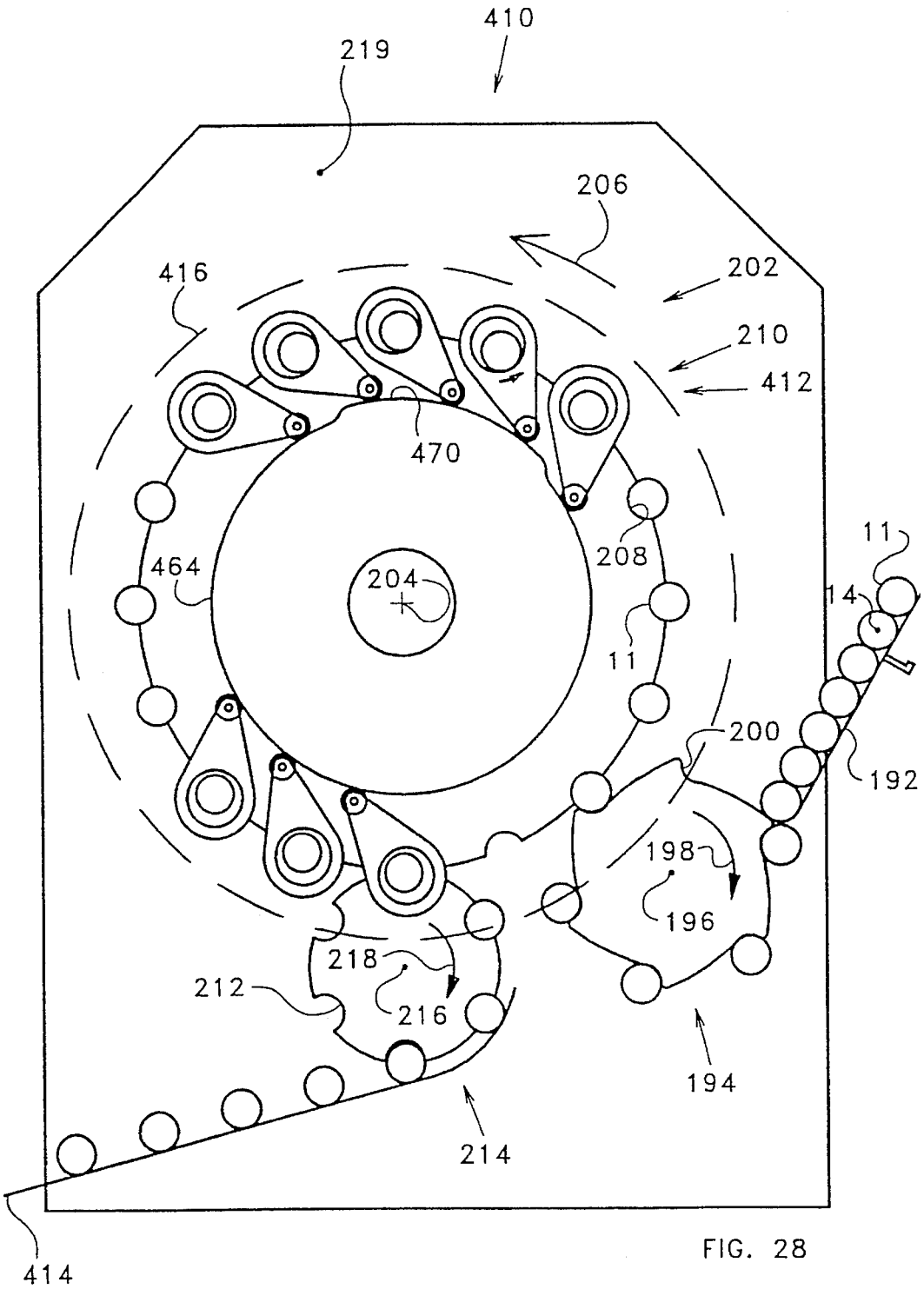
FIG. 28 is a schematic drawing of recess-reforming machine that may be used with the embodiments of FIGS. 26 and 27, taken as shown by view line 28—28 of FIG. 26, but with the turret drum shown in phantom.

Referring now to FIGS. 26–28, a recess-reforming machine 410 of FIGS. 26–28 includes a plurality of recess-reforming apparatus 412 of FIGS. 26 and 27.

Referring now to FIGS. 21 and 28, the recess-reforming machine 410 is constructed, so far as handling and transport of the container body 11 are concerned, along the lines of the spin-forming machine 190 of FIG. 21: depositing respective ones of the container bodies 11 in turret pockets 208 of working stations 210, and transporting the container bodies 11 around the turret 202 during the reforming process.

Therefore, the numbers and terminology used to describe the recess-reforming machine 410 are, for the most part, the same as those used to describe the spin-forming machine 190. However, the recess-reforming machine 410 is designed to perform only the recess-reforming operation, although, as previously taught, the recess-reforming operation may be performed substantially simultaneously with various other can-forming operations.

The recess-reforming machine 410 receives container bodies 11 in the infeed chute 192, transfers the container bodies 11 to successive ones of the turret pockets 208 of the working stations 210 in the turret 202 by means of the can-stop wheel 194, transports the container bodies 11 around the turret 202 .to respective ones of the pick-off pockets 212 in the pick-off wheel 214, and deposits the container bodies 11 onto a discharge chute 414.

A turret drum 416 of FIG. 26, omitted from FIG. 27 but shown in phantom in FIG. 28, is disposed concentric with the axis 204 of the turret 202 and rotates with the turret 202 in the direction of the arrow 206.

A plurality of the recess-reforming apparatus 412 are attached to the turret drum 416 of the recess-reforming machine 410 of FIG. 28, one at each of the working stations 210, but with a few removed to more clearly see other details of the recess-reforming machine 410.

Referring now to FIGS. 26 and 27, the recess-reforming apparatus 412 comprises a dome-receptacle assembly 418 that includes a flanged mounting plate 420 with a flange 422, a bearing bore 424 that is disposed concentric with the container axis 14, a threaded bore 426, and mounting holes 428 that are disposed in the flange 422. The flanged mounting plate 420 is secured to the turret drum 416 by cap screws 430 inserted into the mounting holes 428.

The dome-receptacle assembly 418 further includes a pair of ball bearings 432 that are disposed in the bearing bore 424, a threaded lock ring 434 that is disposed in the threaded bore 426 and that locks the ball bearings 432 in the bearing bore 424, and a dome receptacle 436 with a pair of bearing-receiving surfaces 438 that receive respective ones of the ball bearings 432. The dome receptacle 436 also includes a container-receiving socket 440.

The recess-reforming apparatus 412 further includes a pilot shaft, or tooling portion, 442 that is cylindrical in shape, and that is disposed in a pilot bore 444 in the turret drum 416, the pilot bore 444 being parallel to the container axis 14. Since the pilot bore 444 is disposed in the turret drum 416, the turret drum 416 is a part of each one of the recess-reforming apparatus 412 that are disposed around the turret drum 416.

A tooling element, or reforming roller, 446 is attached to the pilot shaft 442 by a roller shaft 448, the reforming roller 446 and the roller shaft 448 being disposed around a roller axis 450 that is eccentric to the container axis 14.

Finally, the recess-reforming apparatus 412 includes a pivot arm 452 that is attached to the pilot shaft 442 by any suitable means, not a part of the present invention, a cam-follower shaft 454 that is inserted into a bore 456 of the pivot arm 452, and a cam follower 458 that is rotationally attached to the cam-follower shaft 454. As shown in FIG. 26, the pivot arm 452 is attached to the pilot shaft 442 near an end 460 that is opposite to an end 462 on which the dome-receptacle assembly 418 is disposed.

The recess-reforming apparatus 412 of FIGS. 26 and 27 includes a tooling device 463. The tooling device 463 includes the turret drum 416 which serves as a body, the pilot shaft 442, the pivot arm 452, the cam follower 458, the roller shaft 448, and the tooling elements 446.

The recess-reforming machine 410 of FIG. 28 includes a cam 464 that is disposed around the axis 204 of the turret 202, but that is stationary with respect with the turret 202. That is, the recess-reforming apparatus 412 is attached to the turret 202 and rotates around the cam 464 in the direction of the arrow 206.

In operation, as the turret 202 rotates around the axis 204, successive ones of the recess-reforming apparatus 412 proceed around the axis 204, and successive ones of the cam followers 458 engage a rise 470 of the cam 464, thereby rotationally positioning the pilot shaft, or tooling portion, 442 of that particular recess-reforming apparatus 412, thereby rotating the reforming roller 446 outwardly into deforming engagement with the bottom recess portion 25 of a container body 11.

In summary, in the present invention relative transverse movement is provided between a tooling element, 172, 246, 302, 346, 392, or 446 and a container body 11. The tooling element 172, 246, 302, 346, 392, or 446, or the container body 11, or both may rotate around the container axis 14, or both may remain rotationally stationary. If more than one tooling element 172, 246, 302, 346, 392, or 446 is provided, they are radially and circumferentially spaced apart; and the tooling elements may be rollers 172, 246, 302, 350, or 446 or swaging elements 392. Preferably, the tooling elements 172, 246, 302, 346, 392, or 446 are moved radially or transversely outward in response to movement of another portion of the tooling, such as an actuating shaft 166, 252, 308, or 384; and preferably this movement of the other portion of the tooling is either rotational or longitudinal.

Further, the reworking of the bottom recess portion 25 of container bodies 11 that is achieved by the apparatus and methods of the present invention produces container bodies 64 with hooked parts 76 that extend circumferentially around the bottom recess portion 80 as shown in FIGS. 7 and 8, or container bodies 62 with a plurality of arcuately-shaped and circumferentially-spaced parts 100 as shown in FIGS. 5 and 6.

In summary, as shown and described herein, the apparatus and method of the present invention provides container bodies, 62 and 64, in which improvements in roll-out resistance, static dome reversal pressure, and cumulative drop height are all achieved without increasing the metal thickness, without decreasing the dome radius $R_4$, without increasing-the positional distance $L_2$, without increasing the dome height $H_1$, and without appreciably decreasing the fluid capacity of the container bodies, 62 and 64. Or, conversely, the present invention provides container bodies, 62 and 64, in which satisfactory values of roll-out resistance, static dome reversal pressure, and cumulative drop height can be achieved using metal of a thinner gauge than has heretofore been possible.

It is believed that the present invention yields unexpected results. Whereas, in prior art designs, a decrease in the dome radius $R_4$ has decreased the dome reversal pressure, in the present invention, a decrease in the dome radius $R_4$, combined with strengthening the dome positioning portion, 70 or 82, achieves a remarkable increase in both dome reversal pressure and cumulative drop height resistance.

Further, the fact that phenomenal increases in both cumulative drop height resistance and static dome reversal pressures have been achieved by simply reworking a container body of standard dimensions is believed to constitute unexpected results.

When referring to dome radii $R_4$, or to limits thereof, it should be understood that, while the concave domed panels 38 of container bodies 62 and 64 have been made with tooling having a spherical radius, both the spring-back of the concave domed panel 38 of the container body 11, and reworking of the container body 11 into container bodies 62 and 64, change the dome radius from a true spherical radius.

Therefore, in the claims, a specified radius, or a range of radii for the radius, $R_4$ would apply to either a central portion 92 or to an annular portion 94, both of FIGS. 5 and 7.

The central portion 92 has a diameter $D_{CP}$ which may be any percentage of the diameter $D_P$ of the concave domed panel 38; and the annular portion 94 may be disposed at any distance from the container axis 14 and may have a radial width $X_4$ of any percentage of the diameter $D_P$ of the concave domed panel 38.

Further, while the preceding discussion has focused on center panels 38 with radii $R_4$ that are generally spherical, and that are made with spherical tooling, the present invention is applicable to container bodies, 62 or 64, in which the concave domed panels 38 are ellipsoidal, consist of annular steps, decrease in radius of curvature as a function of the distance radially outward of the concave domed panel 38 from the container axis 14, have some portion 92 or 94 that is substantially spherical, include a portion that is substantially conical, and/or include a portion that is substantially flat.

Finally, while the limits pertaining to the shape of the center panel 38 may be defined as functions of dome radii $R_4$, limits pertaining to the shape of the center panel 38 can be defined as limits for the central portion 92 or for the annular portion 94 of the center panel 38, or as limits for the angle $\alpha_3$, whether at the perimeter $P_0$, or at any other radial distance from the container axis 14.

Referring finally to FIGS. 4–11, another distinctive difference in the present invention is in the slope of the inner walls, 71 and 83, of container bodies 62 and 64, respectively. As seen in FIG. 4, the inner wall 42 of the prior art slopes upwardly and inwardly by the angle $\alpha_1$.

In stark contrast to the prior art, the inner wall 83 of the container body 64 of FIGS. 7, 8, and 11 includes a negatively-sloping part 96 that slopes upwardly and outwardly at a negative angle $\alpha_5$. As seen in FIG. 8, the negatively-sloping part 96 extends circumferentially around the container axis 14.

Also in stark contrast to the prior art, the inner wall 71 of the container body 62 of FIGS. 5, 6, and 10 includes a negatively-sloping part 98 that slopes upwardly and outwardly by a negative angle $\alpha_6$, and that is disposed arcuately around less than one-half of the bottom 66 of the container body 62. The inner wall 71 also includes another negatively-sloping part 100 that slopes upwardly and outwardly at the negative angle $\alpha_6$, and that is spaced circumferentially from the negatively-sloping part 98.

Therefore, in the appended claims, the center panel 38 should be understood to be without limitation to a particular, or a single, geometrical shape.

In summary, the present invention provides these remarkable and unexpected improvements by apparatus and method as recited in the aspects of the invention which are included herein.

Although aluminum container bodies have been investigated, it is believed that the same principle, namely increasing the roll-out resistance of the inner wall, from the inner wall 42 of the container body 11 to either the inner wall 71 of container body 62 or the inner wall 83 of the container body 64, would be effective to increase the strength of container bodies made from other materials, including ferrous and nonferrous metals, plastic and other nonmetallic materials.

Figure 2:
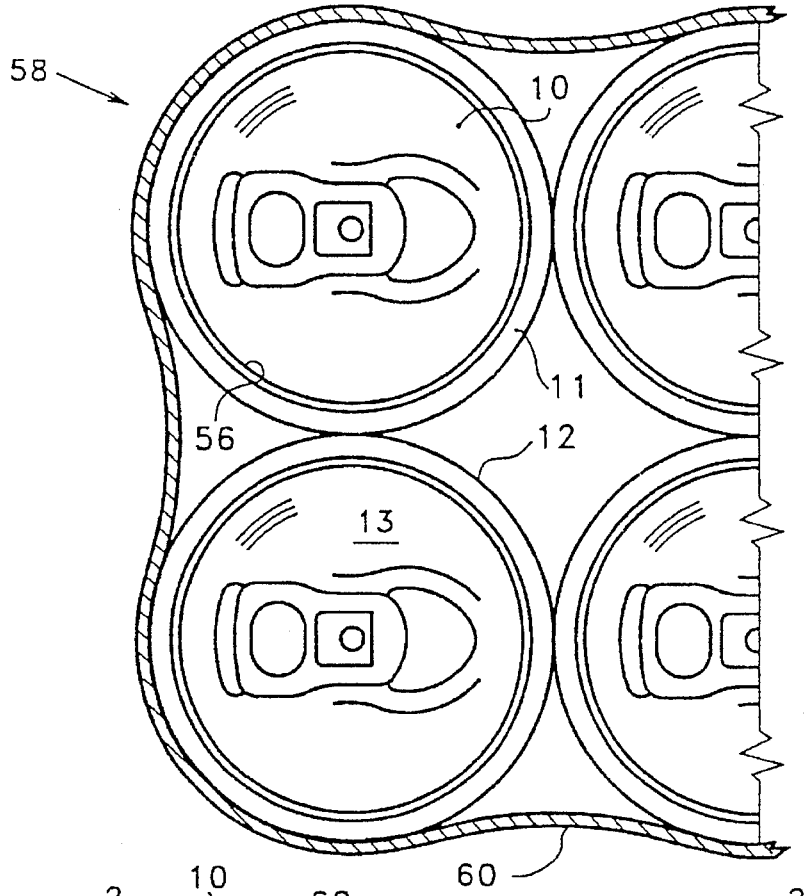
FIG. 2 is a top view of the bundled beverage containers of FIG. 1 taken substantially as shown by view line 2—2 of FIG. 1.
Figure 1:
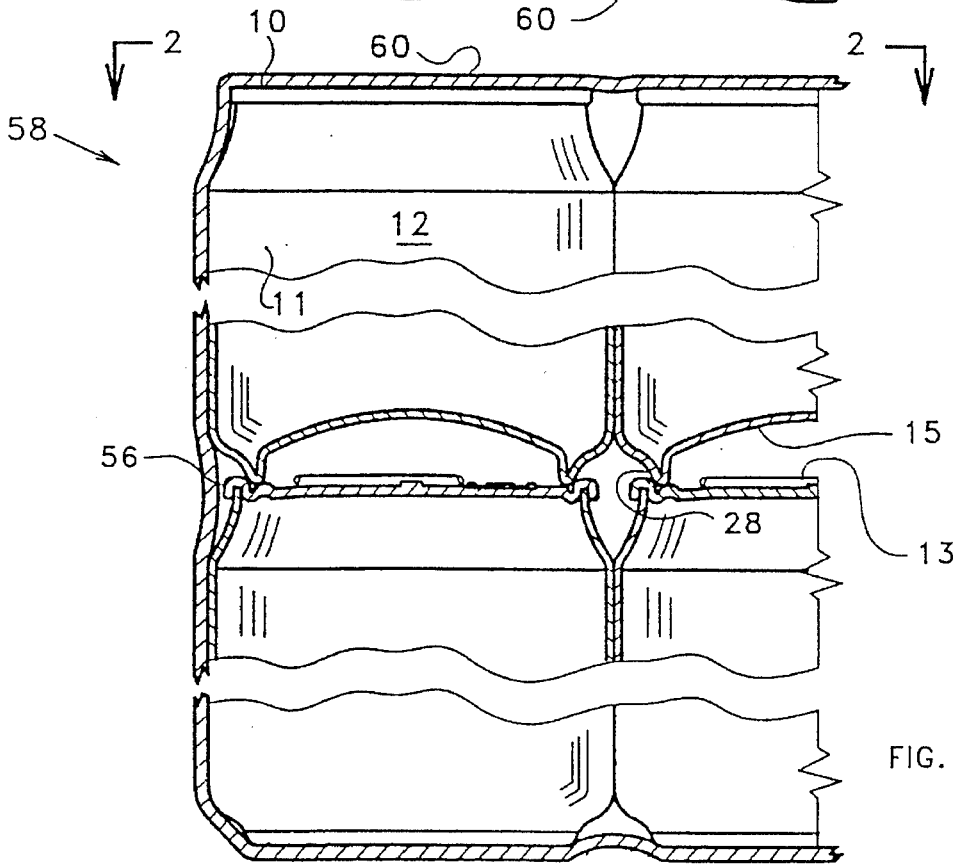
FIG. 1 is a front elevation of beverage containers that are bundled by shrink wrapping with plastic film.

Referring finally to FIGS. 1 and 2, upper ones of the containers 10 stack onto lower ones of the containers 10 with the outer connecting portions 28 of the upper ones of the containers 10 nested inside double-seamed tops 56 of lower ones of the containers 10; and both adjacently disposed and vertically stacked containers 10 are bundled into a package 58 by the use of a shrink-wrap plastic 60.

While this method of packaging is more economical than the previous method of boxing, possible damage due to rough handling becomes a problem, so that the requirements for cumulative drop resistances of the containers 10 is more stringent. It is this problem that the present invention addresses and solves.

While specific methods and apparatus have been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

Industrial Applicability

The present invention is applicable to container bodies made of aluminum and various other materials. More particularly, the present invention is applicable to beverage containers of the type having a seamless, drawn and ironed, cylindrically-shaped body, and an integral bottom with an annular supporting portion.

What is claimed is:

1. A method for forming a drawn and ironed container body, comprising the steps of:

forming a drawn and ironed container body, comprising the steps of forming a substantially cylindrical sidewall disposed about a central axis, forming an annular supporting portion having an annular supporting surface, forming an annular outer connecting portion which interconnects said sidewall and said annular supporting portion, forming a generally domed center panel disposed above said annular supporting portion, and forming an inner wall in a first orientation which interconnects said center panel and said annular supporting portion, wherein an outermost portion of said center panel is disposed at a first vertical distance above a reference plane which contains said annular supporting surface;

reworking at least part of said inner wall using at least one reworking tool, said reworking step comprising forming a first part of said inner wall into a second orientation different from said first orientation, said second orientation comprising said first part of said inner wall extending upwardly relative to said annular supporting portion and outwardly relative to said central axis, said reworking step further comprising forming a second part of said inner wall into a third orientation different from said second orientation, said second part of said inner wall being positioned between said first part and said center panel, wherein an outermost portion of said inner wall relative to said vertical axis is an uppermost portion of said first part, said reworking step further comprising initiating contact between each said reworking tool and said inner wall at a second vertical distance above said reference plane which is substantially less than said first vertical distance whereby said uppermost portion of said first part is positioned at a vertical distance above said reference plane which is substantially less than said first vertical distance of said outermost portion of said center panel.

2. A method, as claimed in claim 1, wherein said forming a container body step further comprises interconnecting said inner wall and said center panel with an annular arcuate portion having a first radius, and wherein said reworking step comprises increasing said first radius.

3. A method, as claimed in claim 1, wherein said reworking step further comprises forming an annular said first part and an annular said second part, said reworking step further comprising forming an annular third part from said inner wall, said third part being positioned between said annular supporting portion and said first part and extending at least upwardly relative to said supporting portion, said second part extending upwardly and inwardly relative to at least part of said first part and said axis, respectively.

4. A method, as claimed in claim 3, wherein said forming annular first, second, and third parts step comprises forming an annular arcuate portion between said second segment and said third segment.

5. A method, as claimed in claim 4, wherein said annular arcuate portion has a radius between about 0.030 inches and about 0.050 inches.

6. A method, as claimed in claim 1, wherein said reworking step comprises using at least one reforming roller, engaging each said reforming roller with only part of said inner wall throughout said reworking step, and relatively advancing each said reforming roller about said inner wall.

7. A method, as claimed in claim 1, wherein said reworking step comprises exerting a concentrated force on substantially a mid-portion of said inner wall.

8. A method, as claimed in claim 1, wherein said reworking step comprises using at least one reforming roller and relatively advancing each said reforming roller about said inner wall.

9. A method, as claimed in claim 8, wherein said reworking step further comprises providing relative transverse movement between all of said container body and each said reforming roller to engage each said reforming roller with part of said inner wall.

10. A method, as claimed in claim 1, wherein said reworking step comprises using at least one pair of reforming rollers spaced apart by about 180°, said at least one pair of reforming rollers exerting diametrically opposed forces on two discrete locations of said inner wall.

11. A method, as claimed in claim 1, wherein said forming step comprises providing a radially innermost annular part of said annular supporting portion with a first diameter, and wherein said method further comprises the step of increasing said first diameter of said radially innermost part of said annular supporting portion to a second diameter using said reworking step.

12. A method, as claimed in claim 1, wherein said reworking step comprises forming a third part of said inner wall between said first part and said annular supporting portion, said third part extending at least upwardly relative to said supporting surface.

13. A method, as claimed in claim 12, wherein said forming an annular supporting portion step further comprises forming annular inner and outer convex portions, said annular supporting surface being positioned between said annular inner and outer convex portions, wherein a vertical extent of said annular inner convex portion is defined by a first radius, wherein said third part is disposed above said annular inner convex portion and extends upwardly relative to said annular inner convex portion in an orientation which is different than an orientation of said annular inner convex portion defined by said first radius.

14. A method, as claimed in claim 1, wherein said reworking step further comprises forming a first end portion of said second part with a first radius, forming a second end portion of said second part with a second radius, and forming an intermediate portion between said first and second end portions in an orientation other than that provided by either of said first and second radiuses, said first and second end portions and said intermediate portion defining a vertical extent of said second part.

15. A method, as claimed in claim 1, wherein said reworking step further comprises forming an annular lower end of said second part to define a diameter greater than a diameter of a radially innermost annular part of said annular supporting portion after said reworking step and forming an annular upper end of said second part to define a diameter less than said diameter of said radially innermost annular part of said annular supporting portion after said reworking step.

16. A method, as claimed in claim 1, wherein said forming step further comprises substantially defining said center panel by a panel radius, said third orientation of said second part being different than an orientation of said center panel provided by said panel radius.

17. A method, as claimed in claim 1, wherein said reworking step comprising disposing said uppermost portion of said first part of said inner wall at a vertical distance of no more than about 0.092 inches above said reference plane.

18. A method, as claimed in claim 1, wherein said reworking step comprises achieving a ratio of said vertical distance of said uppermost portion of said first part of said inner wall to said first vertical distance of said outermost portion of said center panel which is no greater than about 0.57.

19. A method for forming a drawn and ironed, thin-walled beverage container with improved strength, said method comprising the steps of:

forming a drawn and ironed a container body comprising the steps of forming a sidewall disposed around a vertical axis, forming an exteriorly convexly-shaped annular support integrally interconnected with said sidewall and comprising an annular supporting surface, forming a center panel, and forming a panel positioning portion between and integrally interconnecting said center panel and said annular supporting surface, wherein said panel positioning portion is in a first orientation and wherein a radially innermost annular part of said annular support defines a first diameter;

reworking at least part of said panel positioning portion into a second orientation different from said first orientation after said forming step, said second orientation comprising at least part of said panel positioning portion extending upwardly relative to said annular support and outwardly relative to said axis; and increasing said first diameter of said radially innermost part of said annular support to a second diameter using said reworking step.

20. A method, as claimed in claim 19, wherein said forming a container body step further comprises the step of interconnecting said panel positioning portion and said center panel with an annular arcuate portion having a vertical extent substantially defined by a first radius, and wherein said reworking step comprises increasing said first radius to a second radius.

21. A method, as claimed in claim 19, wherein said reworking step comprises forming at least first and second parts from said panel positioning portion, said first part extending upwardly relative to said supporting surface and said second part being positioned above said first part and comprising said at least part of said panel positioning portion.

22. A method, as claimed in claim 21, wherein said forming an annular support step further comprises forming annular inner and outer convex portions, said annular supporting surface being positioned between said annular inner and outer convex portions, said annular inner convex portion comprising said first part and further extending inwardly relative to said axis.

23. A method, as claimed in claim 21, wherein said forming an annular support step-further comprises forming annular inner and outer convex portions, said annular supporting surface being positioned between said annular inner and outer convex portions, wherein a vertical extent of said annular inner convex portion is defined by a first radius, wherein said first part is disposed above said annular inner convex portion and extends upwardly relative to said annular inner convex portion in an orientation which is different than an orientation of said annular inner convex portion defined by said first radius.

24. A method, as claimed in claim 21, wherein said reworking step comprises forming a third part from said panel positioning portion, said third part being positioned above said second part and extending upwardly and inwardly relative to an upper portion of said second part and said vertical axis, respectively.

25. A method, as claimed in claim 24, wherein said forming step further comprises substantially defining said center panel by a panel radius, wherein an orientation of said third part is different than an orientation of said center panel provided by said panel radius.

26. A method, as claimed in claim 24, wherein said forming first, second, and third parts step comprises forming an arcuate portion between said second part and said third part.

27. A method, as claimed in claim 26, wherein said arcuate portion has a radius between about 0.030 inches and about 0.050 inches.

28. A method, as claimed in claim 19, wherein said reworking step further comprises forming at least first and second parts from said panel positioning portion, said first part comprising said at least part of said panel positioning portion, said second part being positioned above said first part and extending upwardly relative to an upper portion of said first part and inwardly relative to said axis.

29. A method, as claimed in claim 28, wherein said forming a second part step comprises forming a first end portion of said second part with a first radius, forming a second end portion of said second part with a second radius, and forming an intermediate portion between said first and second end portions in an orientation other than that provided by either of said first and second radiuses, said first and second end portions and said intermediate portion defining a vertical extent of said second part.

30. A method, as claimed in claim 28, wherein said forming a second part step comprises forming an annular lower end of said second part to define a third diameter greater than said second diameter of said radially innermost annular part of said annular support and forming an annular upper end of said second part to define a fourth diameter less than said second diameter.

31. A method, as claimed in claim 19, wherein said reworking step comprises using at least one reforming roller, engaging each said reforming roller with only part of said panel positioning portion throughout said reworking step, and relatively advancing each said reforming roller about said panel positioning portion.

32. A method, as claimed in claim 19, wherein said reworking step comprises exerting a concentrated force on substantially a mid-portion of said panel positioning portion.

33. A method, as claimed in claim 19, wherein said reworking step comprises using at least one reforming roller and relatively advancing each said reforming roller about said panel positioning portion.

34. A method, as claimed in claim 33, wherein said reworking step further comprises providing relative transverse movement between all of said container body and each said reforming roller to engage each said reforming roller with part of said panel positioning portion.

35. A method, as claimed in claim 19, wherein said reworking step comprises using at least one pair of reforming rollers spaced apart by about 180°, said at least one pair of reforming rollers exerting diametrically opposed forces on two discrete locations of said panel positioning portion.

36. A method, as claimed in claim 19, wherein an outermost portion of said center panel is disposed at a first vertical distance above a reference plane which contains said annular supporting surface and wherein an outermost portion of said panel positioning portion relative to said vertical axis after said reworking step is an uppermost portion of said at least part of said panel positioning portion, said reworking step further comprising using at least one reworking tool and initiating contact between each said reworking tool and said panel positioning portion at a second vertical distance above said reference plane which is substantially less than said first vertical distance whereby said uppermost portion of said at least part of said panel positioning portion is positioned at a vertical distance above said reference plane which is substantially less than said first vertical distance of said outermost portion of said center panel.

37. A method, as claimed in claim 36, wherein said reworking step comprising disposing said uppermost portion of said at least part of said panel positioning portion at a vertical distance of no more than about 0.092 inches above said reference plane.

38. A method, as claimed in claim 36, wherein said reworking step comprises achieving a ratio of said vertical distance of said uppermost portion of said at least part of said panel positioning portion to said first vertical distance of said outermost portion of said center panel which is no greater than about 0.57.

39. A method for forming a drawn and ironed container body, comprising the steps of:

forming a drawn and ironed container body, comprising the steps of forming a substantially cylindrical sidewall disposed about a central axis, forming an annular supporting portion having an annular supporting surface, forming an annular outer connecting portion which interconnects said sidewall and said annular supporting portion, forming a generally domed center panel disposed above said annular supporting portion, and forming an inner wall in a first orientation which interconnects said center panel and said annular supporting portion;

reworking at least part of said inner wall to provide at least first, second, and third parts, said first, second, and third parts each having different orientations relative to said central axis.

* * * * *